US009870593B2

(12) United States Patent
Sedighy et al.

(10) Patent No.: US 9,870,593 B2
(45) Date of Patent: Jan. 16, 2018

(54) SYSTEM, METHOD AND CONTROLLER FOR MANAGING AND CONTROLLING A MICRO-GRID

(71) Applicant: Hatch Ltd., Mississauga (CA)

(72) Inventors: Mohammad Sedighy, Oakville (CA); Mohamed Zakaria Kamh, Toronto (CA); Amgad El-Deib, Niagara Falls (CA); Reza Iravani, Toronto (CA); Abdelrahman Abbas Hagar, Niagara Falls (CA)

(73) Assignee: HATCH LTD., Mississauge (CA)

( * ) Notice: Subject to any disclaimer, the term of this patent is extended or adjusted under 35 U.S.C. 154(b) by 983 days.

(21) Appl. No.: 13/705,635

(22) Filed: Dec. 5, 2012

(65) Prior Publication Data

US 2013/0166084 A1 Jun. 27, 2013

Related U.S. Application Data

(60) Provisional application No. 61/567,045, filed on Dec. 5, 2011.

(51) Int. Cl.
*G06Q 50/06* (2012.01)

(52) U.S. Cl.
CPC ..... *G06Q 50/06* (2013.01)

(58) Field of Classification Search
CPC ..... G06Q 50/06
(Continued)

(56) References Cited

U.S. PATENT DOCUMENTS 3,652,838 A 3/1972 Dillon et al.
5,289,362 A 2/1994 Liebl et al.
(Continued)

FOREIGN PATENT DOCUMENTS

EP 2202862 * 11/2009 ..... H02J 3/16
EP 2202862 A1 6/2010
(Continued)

OTHER PUBLICATIONS

Liyanage et al, "Coordinated Control of Elements in Ubiquitous Power Networks to Support Load Frequency Control", 2009, pp. 430-435.*
(Continued)

*Primary Examiner* — Miranda Huang
*Assistant Examiner* — Olvin Lopez Alvarez
(74) *Attorney, Agent, or Firm* — Bereskin & Parr LLP/S.E.N.C.R.L., s.r.l.

(57) ABSTRACT

A system, method and controller for managing and controlling a micro-grid network. The system includes a plurality of energy resources including at least one dispatchable energy resource and at least one intermittent energy resource, wherein the at least one of the energy resources is an energy storage element and at least one of the intermittent energy resources is responsive to environmental conditions to generate power, a controller configured to record operational constraints of the energy resources, obtain an environmental condition prediction and generate a component control signal based on the environmental condition prediction and the operational constraints corresponding to the energy resources. The controller is further configured to receive a network disturbance signal and generate a dynamic control signal based on such disturbances.

30 Claims, 9 Drawing Sheets

(58) Field of Classification Search
USPC ..... 700/291
See application file for complete search history.

(56) References Cited

U.S. PATENT DOCUMENTS

| | | | | |
|---|---|---|---|---|
| 5,422,561 | A | 6/1995 | Williams et al. | |
| 5,675,503 | A | 10/1997 | Moe et al. | |
| 5,973,481 | A | 10/1999 | Thompson et al. | |
| 6,681,154 | B2 | 1/2004 | Nierlich et al. | |
| 6,882,904 | B1 | 4/2005 | Petrie et al. | |
| 7,016,793 | B2 | 3/2006 | Ye | |
| 7,116,010 | B2 | 10/2006 | Lasseter et al. | |
| 7,149,605 | B2 | 12/2006 | Chassin et al. | |
| 7,274,975 | B2 | 9/2007 | Miller | |
| 7,321,500 | B2 * | 1/2008 | Asplund | H02J 3/36 363/35 |
| 7,476,987 | B2 | 1/2009 | Chang | |
| 7,536,240 | B2 | 5/2009 | McIntyre et al. | |
| 7,671,481 | B2 | 3/2010 | Miller et al. | |
| 7,920,942 | B2 | 4/2011 | Lasseter et al. | |
| 7,925,597 | B2 | 4/2011 | Takano | |
| 7,973,427 | B2 | 7/2011 | Korba et al. | |
| 8,463,451 | B2 | 6/2013 | Kumula | |
| 2001/0012211 | A1 | 8/2001 | Hasegawa | |
| 2002/0087234 | A1 | 7/2002 | Lof | |
| 2002/0136260 | A1 | 9/2002 | Ma et al. | |
| 2003/0220752 | A1 | 11/2003 | Hart | |
| 2004/0242256 | A1 | 12/2004 | Xiao et al. | |
| 2004/0254688 | A1 | 12/2004 | Chassin et al. | |
| 2005/0077881 | A1 | 4/2005 | Capp | |
| 2006/0276938 | A1 * | 12/2006 | Miller | G06Q 50/06 700/295 |
| 2006/0279088 | A1 | 12/2006 | Miller et al. | |
| 2007/0100506 | A1 | 5/2007 | Teichmann | |
| 2007/0222294 | A1 | 9/2007 | Tsukida et al. | |
| 2008/0195255 | A1 | 8/2008 | Lutze et al. | |
| 2008/0278000 | A1 * | 11/2008 | Capp | H02J 3/04 307/21 |
| 2009/0024255 | A1 * | 1/2009 | Penzenstadler | H02J 3/1842 700/297 |
| 2009/0040029 | A1 | 2/2009 | Bridges et al. | |
| 2009/0076661 | A1 | 3/2009 | Pearson et al. | |
| 2009/0112375 | A1 | 4/2009 | Popescu | |
| 2009/0160187 | A1 | 6/2009 | Scholte-Wassink | |
| 2009/0174262 | A1 * | 7/2009 | Martin | H02M 3/157 307/82 |
| 2009/0234510 | A1 | 9/2009 | Helle et al. | |
| 2010/0008119 | A1 | 1/2010 | O'Brien et al. | |
| 2010/0176770 | A1 | 7/2010 | Fortmann | |
| 2010/0185336 | A1 * | 7/2010 | Rovnyak | H02J 3/38 700/287 |
| 2010/0198421 | A1 * | 8/2010 | Fahimi | H02J 3/32 700/291 |
| 2010/0204844 | A1 * | 8/2010 | Rettger | H02J 3/06 700/291 |
| 2010/0219808 | A1 | 9/2010 | Steckley et al. | |
| 2010/0274407 | A1 | 10/2010 | Creed | |
| 2010/0306027 | A1 | 12/2010 | Haugh | |
| 2010/0308765 | A1 | 12/2010 | Moore et al. | |
| 2011/0004358 | A1 | 1/2011 | Pollack et al. | |
| 2011/0062708 | A1 | 3/2011 | Prochaska et al. | |
| 2011/0106321 | A1 * | 5/2011 | Cherian | H02J 3/00 700/286 |
| 2011/0137482 | A1 | 6/2011 | Toba et al. | |
| 2011/0166717 | A1 | 7/2011 | Yasugi | |
| 2011/0169461 | A1 | 7/2011 | Deaver, Sr. | |
| 2011/0172837 | A1 * | 7/2011 | Forbes, Jr. | G06Q 10/00 700/291 |
| 2011/0251732 | A1 | 10/2011 | Schweitzer et al. | |
| 2011/0276192 | A1 | 11/2011 | Ropp | |
| 2011/0276194 | A1 * | 11/2011 | Emalfarb | B60L 11/1838 700/297 |
| 2011/0307109 | A1 | 12/2011 | Sri-Jayantha | |
| 2011/0309804 | A1 * | 12/2011 | Yasugi | F03D 7/0284 322/19 |
| 2011/0316480 | A1 * | 12/2011 | Mills-Price | H02J 3/1821 320/109 |
| 2011/0320053 | A1 * | 12/2011 | Dozier | H02J 3/38 700/287 |
| 2012/0029720 | A1 | 2/2012 | Cherian et al. | |
| 2012/0029897 | A1 * | 2/2012 | Cherian | H02J 3/00 703/18 |
| 2012/0080420 | A1 | 4/2012 | Hui | |
| 2012/0086273 | A1 | 4/2012 | Rognli | |
| 2012/0109390 | A1 | 5/2012 | Delong et al. | |
| 2012/0158202 | A1 | 6/2012 | Yano et al. | |
| 2012/0185106 | A1 | 7/2012 | Ghosh | |
| 2012/0200160 | A1 | 8/2012 | Pratt et al. | |
| 2012/0226386 | A1 | 9/2012 | Kulathu et al. | |
| 2012/0265356 | A1 | 10/2012 | Yasugi | |
| 2012/0323396 | A1 * | 12/2012 | Shelton | H02J 3/381 700/297 |
| 2013/0024032 | A1 | 1/2013 | Vukojevic et al. | |
| 2013/0076140 | A1 * | 3/2013 | Darden | H02J 3/381 307/64 |
| 2013/0079943 | A1 | 3/2013 | Darden et al. | |
| 2013/0184884 | A1 * | 7/2013 | More | F03D 7/0284 700/291 |

FOREIGN PATENT DOCUMENTS

| | | | | |
|---|---|---|---|---|
| JP | 11-285152 | | 10/1999 | |
| JP | 2006-204081 | | 8/2006 | |
| JP | 201161963 | * | 3/2011 | H02J 3/00 |
| JP | 2011061963 | A | 3/2011 | |
| WO | 2010130615 | A2 | 11/2010 | |

OTHER PUBLICATIONS

Hatziargyriou et al, Microgrids: An Overview of Ongoing Research, Development, and Demonstration Projects, 2007, pp. 17.*

Joseph et al, "Battery Storage Systems in Electric Power Systems", 2006, IEEE, pp. 1-8.*

Abb, "Improved Power System Performance through Wide Area Monitoring, Protection and Control", 2004, pp. 1-24.

Hatziargyriou et al, Microgrids: An Overview of Ongoing Research, Development, and Demonstration Projects, IEEE Power & Energy Magazine, Jul./Aug. 2007, pp. 78-94.

Katiraei et al, "Microgrids Management", IEEE Power & Energy Magazine, May/Jun. 2008, pp. 54-65.

Katiraei et al, "Power Management Strategies for a Microgrid with Multiple Distributed Generation Units", IEEE, Nov. 2006, pp. 1821-1831, vol. 21, No. 4.

Lugo et al, "Agent Technologies for Control Applications in the Power Grid", Proceedings of the 43rd Hawaii International Conference on System Sciences, IEEE, 2010, pp. 1-10.

Mynam et al, "Islanding Detection and Adaptive Load Shedding", SEL Application Note 2009, pp. 1-2, Schweitzer Engineering Laboratories, Inc. Pullman, USA.

NERC, "Balancing and Frequency Control a technical document prepared by the NERC Resources Subcommittee", Jan. 26, 2011, pp. 1-54, Princeton, USA.

Simon et al, "Smart Dispatch of Controllable Loads with High Penetration of Renewables", IEEE, 2012, pp. 1-6.

Trudnowski et al, "Power-System Frequency and Stability Control Using Decentralized Intelligent Loads", IEEE, 2006, pp. 1-7.

Short, J.A. et al. "Stabilization of Grid Frequency Through Dynamic Demand Control", Abstract, Power Systems, IEEE Transactions, Aug. 2007, vol. 22, Issue 3, (ISSN: 0885-8950).

Infield, D.G. et al. "Potential for Domestic Dynamic Demand-Side Management in the UK", Abstract, Power Engineering Society General Meeting, 2007. IEEE, Jun. 24-28, 2007 (ISSN: 1932-5517), Loughborough.

Document relating to Canadian Application No. 2,858,189, dated Nov. 1, 2017 (Office Action).

Kunisch et al., "Battery Energy Storage Another Option for Load-Frequency-Control and Instantaneous Reserve", IEEE Transactions on Energy Conversion (vol. EC-1, Issue: 3, Sep. 1986), EC-1, pp.

(56) References Cited

OTHER PUBLICATIONS 41-46, http://ieeexplore.ieee.org/stamp/stamp.jsp?arnumber=4765732, Sep. 1986 (Sep. 1986).

* cited by examiner

SYSTEM, METHOD AND CONTROLLER FOR MANAGING AND CONTROLLING A MICRO-GRID

FIELD

The described embodiments relate to energy management and control for power networks, and more particularly to energy management and control for micro-grid networks.

BACKGROUND

Micro-grids are clusters of distributed energy resources (DERs) and loads that are served at distribution voltage levels. Micro-grids may be operable in a grid-connected mode or an autonomous mode (islanded or isolated). A micro-grid operates in an islanded mode when it is not connectable to a main utility grid. Electrical loads in remote locations, such as industrial facilities and residential communities, are often not connectable to main utility grids and often rely on local dispatchable energy resources, such as, fossil-fuel thermal generation resources including diesel gensets, micro gas turbines etc., for their energy supply. A micro-grid operates in an isolated mode when it is disconnected from the main utility grid but is nevertheless connectable to the main utility grid.

Micro-grids in autonomous modes tend to primarily rely on dispatchable energy resources. Because of high price of fossil fuels used in dispatchable energy resources, operation, control and maintenance of micro-grids tend to have high energy costs. Energy costs can be significantly reduced by incorporating intermittent energy resources, such as, for example, renewable energy resources, relying on wind, solar etc., to offset fossil fuel consumption.

SUMMARY

In a first broad aspect, some embodiments of the invention provide a method of controlling a micro-grid network. The micro-grid network includes a plurality of energy resources including at least one dispatchable energy resource and at least one intermittent energy resource. At least one of the energy resources in the micro-grid network is an energy storage element and at least one of the intermittent energy resources is responsive to environmental conditions to generate power. The method includes: recording at least one operational constraint corresponding to each energy resource; obtaining an environmental condition prediction; and generating a component control signal for at least some of the energy resources, including the energy storage element, based on the environmental condition prediction and the operational constraints corresponding to the energy resource.

In another broad aspect, some embodiments of the invention provide a controller for a micro-grid network. The micro-grid network includes a plurality of energy resources including at least one dispatchable energy resource and at least one intermittent energy resource. At least one of the energy resources in the micro-grid network is an energy storage element and at least one of the intermittent energy resources is responsive to environmental conditions to generate power. The controller includes: a recording module coupled to each energy resource, including the energy storage element, and configured to record at least one operational constraint corresponding to each energy resource; a receiving module coupled to a prediction module and configured to obtain an environmental condition prediction; a processing module coupled to the recording module and the receiving module and configured to generate a component control signal for at least some of the energy resources, including the energy storage element, based on the environmental condition prediction and the operational constraints corresponding to the energy resources; and a data storage module coupled to the processing module and configured to store the at least one operational constraint corresponding to each energy resource, the environmental condition prediction and the component control signal generated for at least some of the energy resources.

In another broad aspect, some embodiments of the invention provide a system of controlling a micro-grid network. The system includes: a plurality of energy resources including at least one dispatchable energy resource and at least one intermittent energy resource, wherein the at least one of the energy resources is an energy storage element and at least one of the intermittent energy resources is responsive to environmental conditions to generate power; a controller coupled to the energy resources and configured to record at least one operational constraint corresponding to each energy resource, obtain an environmental condition prediction, and generate a component control signal for at least some of the energy resources, including the energy storage element, based on the environmental condition prediction and the operational constraints corresponding to the energy resources; and a storage module coupled to the plurality of energy resources and the controller and configured to store the operational constraints corresponding to each energy resource, the environmental condition prediction and the component control signals.

BRIEF DESCRIPTION OF THE DRAWINGS

Preferred embodiments of the present invention will now be described in detail with reference to the drawings, in which.

Figure 1:
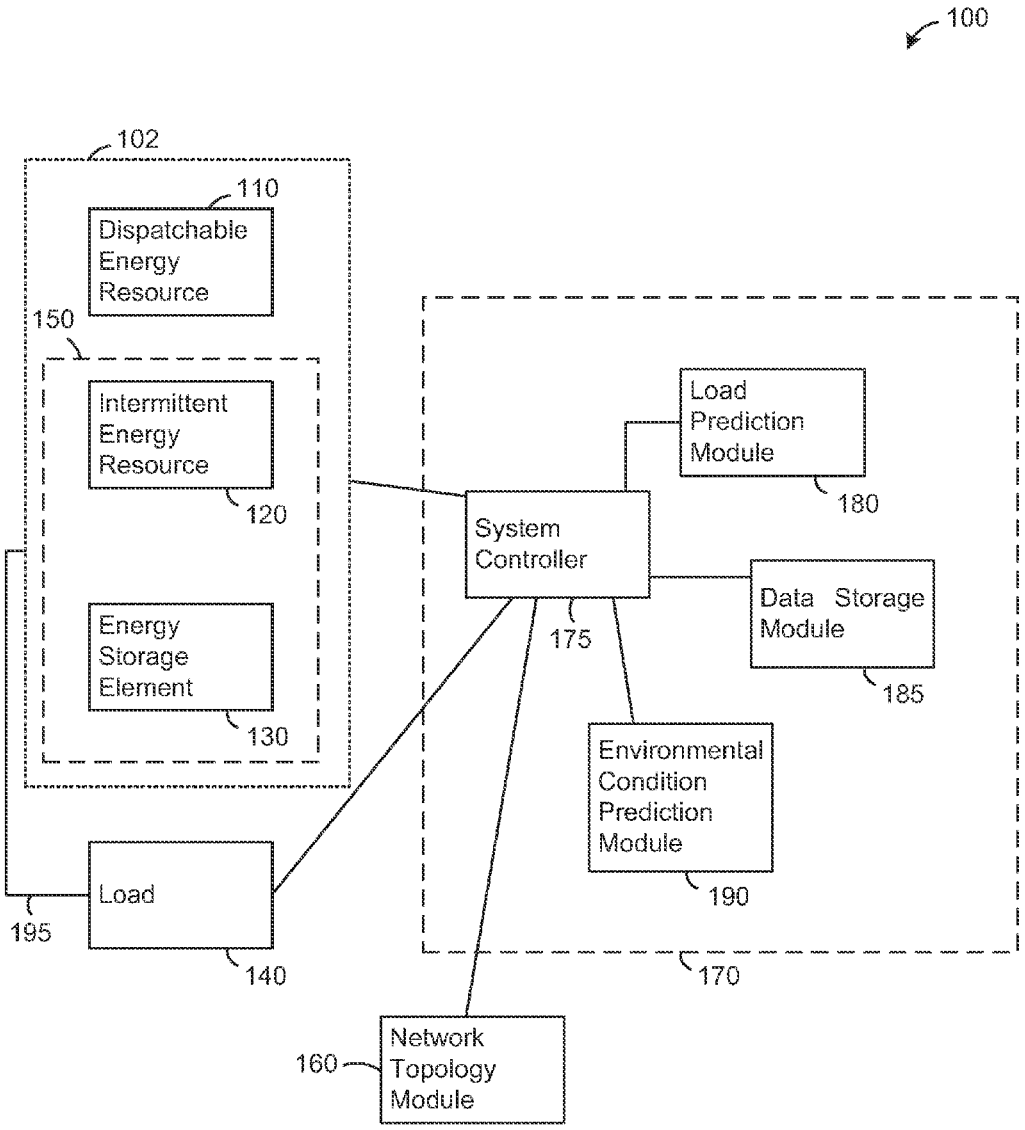
FIG. 1 is a block diagram of a micro-grid network system in accordance with an example embodiment.

The drawings, described below, are provided for purposes of illustration, and not of limitation, of the aspects and features of various examples of embodiments described herein. The drawings are not intended to limit the scope of the teachings in any way. For simplicity and clarity of illustration, elements shown in the figures have not necessarily been drawn to scale. The dimensions of some of the elements may be exaggerated relative to other elements for clarity. Further, where considered appropriate, reference numerals may be repeated among the figures to indicate corresponding or analogous elements.

DESCRIPTION OF EXEMPLARY EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various embodiments described herein.

The embodiments of the methods, systems and apparatus described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example, a suitable programmable computers may be a server, network appliance, set-top box, embedded device, computer expansion module, personal computer, laptop, personal data assistant, mobile device or any other computing device capable of being configured to carry out the methods described herein. Program code is applied to input data to perform the functions described herein and to generate output information. The output information is applied to one or more output devices, in known fashion. In some embodiments, the communication interface may be a network communication interface. In embodiments in which elements of the invention are combined, the communication interface may be a software communication interface, such as those for inter-process communication (IPC). In still other embodiments, there may be a combination of communication interfaces implemented as hardware, software, and combination thereof.

Each program may be implemented in a high level procedural or object oriented programming or scripting language, or both, to communicate with a computer system. For example, a program may be written in XML, HTML 5, and so on. However, alternatively the programs may be implemented in assembly or machine language, if desired. The language may be a compiled or interpreted language. Each such computer program may be stored on a storage media or a device (e.g. ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the methods, systems and apparatus of the described embodiments are capable of being distributed in a computer program product including a physical non-transitory computer readable medium that bears computer usable instructions for one or more processors. The medium may be provided in various forms, including one or more diskettes, compact disks, tapes, chips, magnetic and electronic storage media, and the like. The computer useable instructions may also be in various forms, including compiled and non-compiled code.

The described embodiments may generally provide systems, methods and apparatus to facilitate control and management of a micro-grid network. The described systems, methods and apparatus may attempt to minimize fuel consumption in dispatchable energy resources while maximizing intermittent energy resource penetration. The described systems, methods and apparatus may forecast load demand and weather conditions, and minimize fuel consumption by optimizing operation of generation and storage resources based on forecasted load demand and weather conditions.

Reference is first made to FIG. 1, illustrating a schematic block diagram of a micro-grid network 100 in accordance with an example embodiment. Network 100 comprises a plurality of distributed energy resources (DERs) 102, one or more loads 140 and a power generation controller 170. DERs 102 comprise one or more dispatchable energy resources 110 and one or more electronically-coupled energy resources 150. In various cases, the micro-grid network 100 may have a radial topology.

Electronically-coupled energy resources 150 comprise one or more intermittent energy resources 120 and one or more energy storage elements 130. The distributed energy resources 102 are coupled to the loads 140 through a power grid 195. The load 140 may be any type of electrical load. Typically, the loads 140 will be time-varying.

In various cases, network 100 also comprises a network topology module 160. Network topology module 160 is configured to provide access to the status of various switching devices in the micro-grid network 100. Network topology module 160 may be configured to provide access to the status of breakers, fuses, disconnects etc. within the network 100.

Network topology module 160 may maintain a system admittance matrix and update it in real-time based on the status of the switching devices. In some cases, module 160 may receive the status of switching devices from other or sources. In some other cases, network topology module 160 may analyse and determine the status of the distribution network on its own.

As used herein, the term "dispatchable" refers to an energy resource whose power output can be controlled or adjusted within a wide range as allowed by the operational constraints of the energy resource. For example, a diesel generator, when supplied with sufficient fuel, can typically be controlled to provide a desired power output.

As used herein, the term "intermittent" refers to an energy resource having a limited power generation capability based on the presence or absence of an energy source or other factor, such as an environmental factor, that is not under the control of an operator of the energy resource. For example, the power generated by a wind based energy resource, such as a wind turbine, is limited by the magnitude of the wind incident on its blades; a solar energy resource is limited by the amount of light that reaches its panel; a wave based energy resource can only generate power when it is subject to waves. An intermittent energy resource may be dispatchable to some extent. For example, power generated by a wind turbine may be controlled to some extent by varying the pitch angle of the turbine's blades. However, in the absence of sufficient wind, the turbine will not generate any power.

As used herein, the term "electronically-coupled energy resources" refers to energy resources of the micro-grid network that connect to an AC micro-grid backbone via three-phase or single-phase DC-AC voltage-sourced converter (VSC). Electronically-coupled energy resources include, but are not limited to, intermittent energy resources 120 and energy storage elements 130. Energy storage elements 130 refer to energy resources capable of storing power, such as, for example, battery stations, flywheel stations etc.

Micro-grid network 100 maintains certain parameters of the power supply, including frequency and voltage, within acceptable limits according to standards and operational guidelines to ensure the quality of the power supply. The frequency of the power network supply may vary depending on the balance between the total load-side consumption and generation of real power. The voltage of the power network supply may vary depending on the balance between the total load-side consumption and generation of reactive power.

Various characteristics, including rotating inertia, reactive power levels and short circuit level (or grid stiffness) of the power supply in micro-grid networks vary constantly resulting in continuously changing characteristics of the power network. The micro-grid network 100 may, therefore, use complex control systems to maintain its voltage and frequency stability and guarantee an acceptable quality of power for consumers.

Furthermore, in micro-grid networks, demand continuously fluctuates and is generally not within the control of the power network operator. In addition, with proliferation of intermittent energy resources in the micro-grid network, an additional element of unpredictability or at least unavailability of some energy resources may be added to the generation capacity.

Maintaining a balance between generation and demand in a micro-grid network is important for reliable operation of the network. Sufficient mismatching of generation and demand may result in large frequency excursions on the system bus, which both lowers the overall efficiency of the power network and tends to increase equipment wear and damage resulting in increased maintenance costs in the long run.

The described systems, methods and apparatus may, in addition to steady state control, allow fast dynamic control of real and reactive power to maintain the voltage and frequency stability of the micro-grid 100 subsequent to system disturbances.

In micro-grid networks, such as, for example, in the micro-grid network 100, dispatchable energy resources 110 have operational constraints that should be complied with to extend the service life time of the network and minimize the maintenance costs of the dispatchable resources 110 and of the overall network 100. In various other cases of micro-grid networks 100, the intermittent energy resources 120 may also have several operational constraints that may also need to be maintained to extend the service life time of the micro-grid network 100.

Examples of operational constraints for a dispatchable energy resource 110, such as, for example, a diesel power generation system, may include minimum loading and limited switching cycles. Operation of a diesel power generation system under a light-load condition may increase the risk of engine failure and minimize efficiency. A diesel power generation system that operates on a light load condition for long durations may run the risk of failing to hold high loads by, for example, glazing a cylinder bore. Similarly, turning a diesel power generation system on and off abruptly may damage the generator and reduce its life time.

Different DERs 102 may have different costs and efficiencies associated with them. For example, operating a dispatchable resource 110 such as a diesel generator requires the consumption of diesel fuel. On the other hand, power obtained from an intermitted energy resource 120, such as a wind power generation resource requires only sufficient wind. When sufficient wind is available, it is generally free. By increasing the penetration of intermitted energy resource, e.g. wind power generation, the system operator can reduce the cost of generation for network 100.

Figure 8:
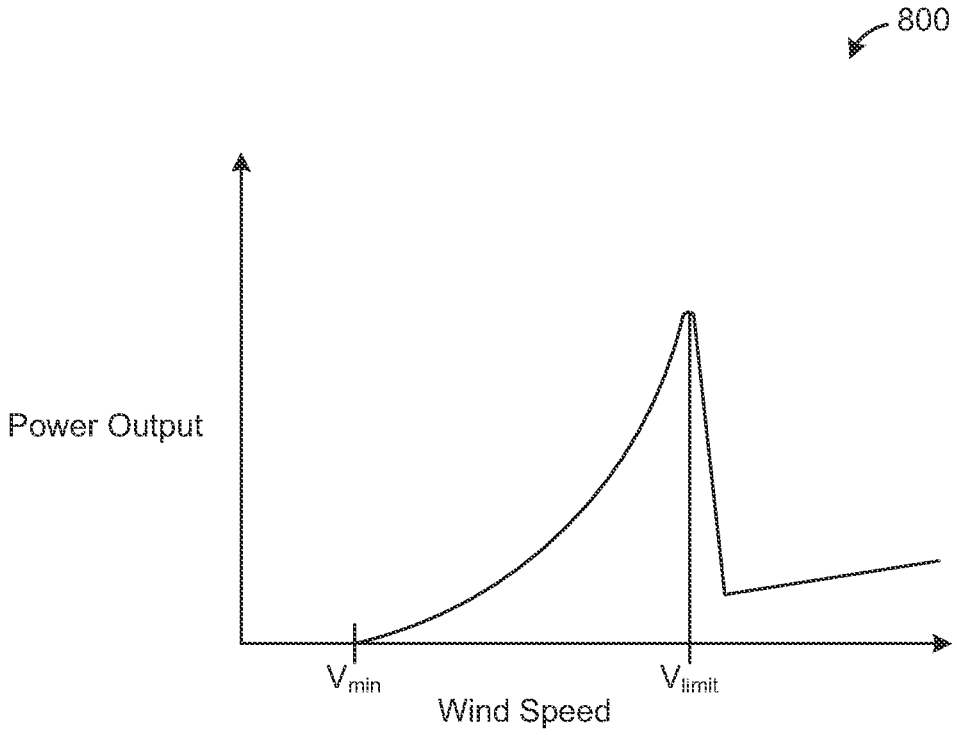
FIG. 8 illustrates a relationship between wind speed and power output for a wind-based intermittent energy resource.

Typically, an intermittent resource 120 will generate an amount of power that corresponds to one or more environmental conditions. FIG. 8 illustrates a relationship between wind strength and power output for an example wind power generation resource. When wind speed is below a minimum wind speed threshold $V_{min}$, the output power of the wind power generation source is zero. As wind speed rises from $V_{min}$ to $V_{limit}$, the maximum output power of the wind power generation resource increases. $V_{limit}$ represents a maximum wind speed at which the wind power generation resource is able to operate efficiently. At wind speeds beyond $V_{limit}$, the wind power generation resource's maximum power output falls significantly. At any time, an operator can obtain power from the wind power generation resource up to the maximum output power depending on the current wind speed. The operator may be able to configure the wind power generation resource, for example, by adjusting the pitch of blades, to adjust its power output.

Referring back to FIG. 1, the power generation controller 170 comprises a system controller 175, an intermittent supply prediction module 190, a load demand prediction module 180 and a data storage module 185.

System controller 175 of network 100 facilitates a steady state optimization and a dynamic predictive control and management of the micro-grid network 100.

System controller 175 may receive inputs from the various DERs 102, load 140 and network topology module 160 and generate steady state optimal or quasi-optimal dispatch commands for the dispatchable resources, intermittent resources and storage resources to minimize dispatchable resource consumption. System controller 175 may also minimize system losses and maximize system reliability and generation adequacy. System controller 175 may also generate dynamic dispatch commands for the various distributed resources to maintain system integrity during transients.

In some cases, power generation controller 170 may also include more than one system controllers 175. If more than one system controller 175 is provided, they may be configured so that there is one central system controller and one or more local system controllers that operate under the control of the central system controller.

Power generation controller 170 also includes a data storage module 185. The storage module 185 may be any data storage device known in the art, such as a hard disk drive, tape drive, solid state drive, or data storage device from which the system controller 175 may obtain data and in which the system controller 175 may record data.

In some cases, power generation controller 170 may comprise a plurality of storage devices which cooperate to perform the functions of the storage module 185 as described herein. For example, the storage module 185 may comprise internet based cloud storage where information is stored across a plurality of data servers in a plurality of geographical locations. The storage module 185 may be coupled to one or more blocks of system controllers 175 and operate to store a plurality of information received from such modules. The storage module 185 is also operable to provide a plurality of information to these various modules. The storage module 185 may also be provided with pre-stored information.

In some cases, the storage module 185 may receive and store one or more operational constraints from one or more distributed energy resources, such as, for example, the dispatchable energy resource 110. In some other cases, the storage module 185 may contain pre-stored information regarding the operational constraints of various energy resources.

The storage module 185 may also store environmental condition predictions, environmental condition variables or both. Load demand prediction values for the power network may also be stored in the storage module 185.

The storage module 185 may be further configured to store various component control signals and dynamic control signals generated by the system controller 175.

In various cases, the power generation controller 170 may include an environmental condition prediction module 190 to predict one or more environmental conditions. The environmental condition prediction module 190 may alternatively, or in addition, be included within the system controller 175. Environmental condition predictions from module 190 may be used to predict supply from intermittent power resources 120.

The environmental condition prediction module 190 may be coupled to an external data source, such as a meteorological station, or an external database. The external database may contain records of various environmental conditions for a location over a period of time. The records may indicate weekly, monthly, annual etc. patterns or trends of weather conditions. Historical records and other environmental condition data may also be stored within or be accessible to the environmental condition prediction module 190 to facilitate generation of environmental condition prediction values.

In some cases, the environmental condition prediction module 190 may receive one or more environmental condition variables, such as wind speed, air density, irradiance, humidity, atmospheric turbulence, rain conditions, snow conditions, air temperature etc. The environmental condition prediction module 190 may then use the one or more environmental condition variables to determine the environmental condition predictions.

The environmental condition prediction may be obtained for a time period of any duration, such as a few days, hours or minutes. The time period may be customized to a predefined window and not be changeable, or it may be dynamically changed.

An environmental condition prediction may be obtained at a location that is geographically spaced from the location of an intermittent energy resource. For example, a wind speed or velocity measurement may be obtained at a distance from a wind energy resource. The environmental condition prediction module 190 may be configured to take into account any such distance in estimating an environmental condition at the location of the wind energy resource.

Similarly, cloud conditions at a location spaced from a solar energy resource may be used to generate an environmental condition prediction relating to light availability at the location of the solar energy resource and the distance may optionally be taken into account. In some cases, other conditions, such as elevation, nearby structures and obstructions and other factors that may affect an environmental condition at the location of an intermittent power source may be taken into account. For example, if a wind speed measurement is taken at a different height than the blade height of a wind turbine, the difference in elevation may be taken into account in generating an environmental condition prediction. Data relating to the relevance of factors relating to such distances, heights and other factors may be recorded in the data storage module 185 such that they are accessible by the environmental condition prediction module 190.

The power generation controller 170 may also include a load prediction module 180 configured to predict a load demand for the micro-grid network 100. The predicted load demand for the micro-grid network 100 may be used to indicate the total load demand of some future time that is to be met by the total supply of the network 100 to maintain stable system parameters, such as system frequency and voltage. For example, in some cases, the load demand may be predicted for 10 minutes and updated constantly every 10 minutes. In some other cases, the load demand may be predicted for any other duration of time, e.g. 15 minutes, 30 minutes etc., and updated constantly.

In some cases, the total predicted load demand may be predicted in part based on the environmental condition predictions or environmental condition variables. In some other cases, the total predicted load demand may be predicted based on external databases, such as, for example, historical databases containing patterns or trends of load increase or decrease for certain locations. The load variations may be recorded with respect to time, days, seasons, months, years etc.

The load demand may also be predicted based on energy demand forecasting simulation programs. For a solar power generation system in a power network, simulation programs such as CEDMS (Commercial Energy Demand Model System) or REDMS (Residential Energy Demand Model System) may be used to predict load demand for a location relying on a solar power generation system.

Figure 2A:
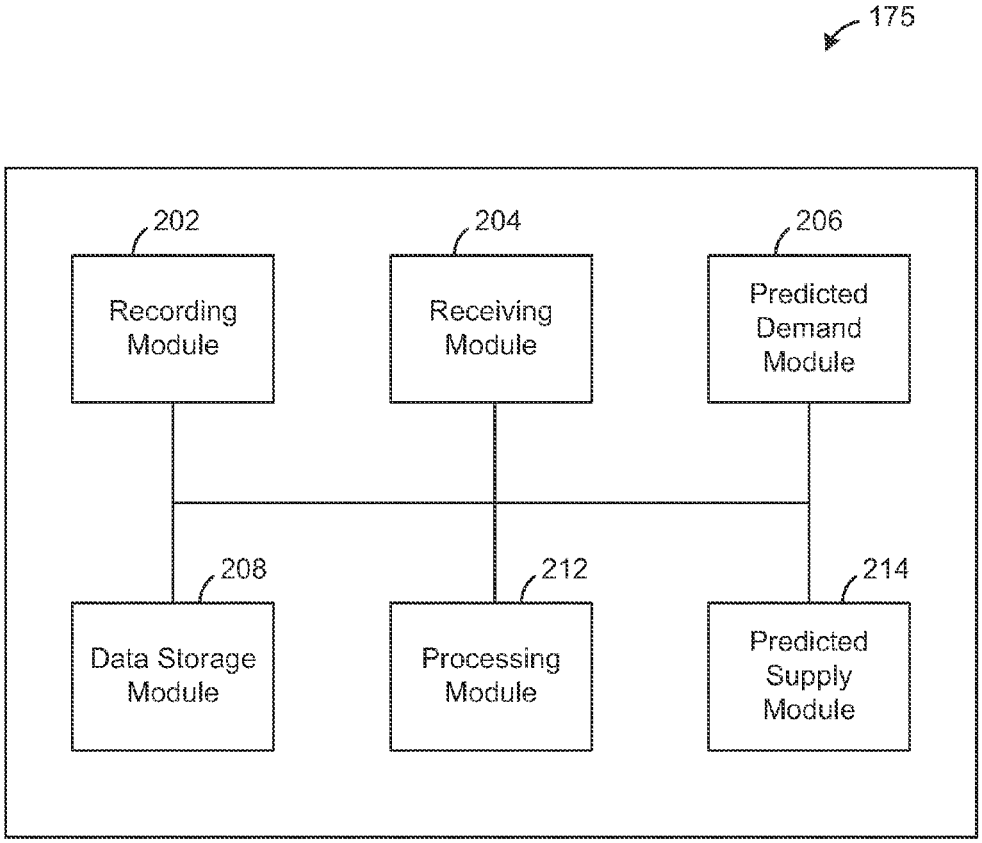
FIG. 2A is a block diagram of a controller in accordance with an example embodiment.

Reference is now made to FIG. 2A, illustrating a schematic block diagram of a system controller 175 in accordance with an example embodiment. System controller 175 comprises one or more recording modules 202, one or more receiving modules 204, one or more predicted demand modules 206, one or more data storage modules 208, one or more processing modules 212 and one or more predicted supply modules 214.

The recording module 202 may record at least one operational constraint corresponding to the distributed energy resources. Examples of operational constraints for a dispatchable energy resource, such as, for example, a diesel generator, may include minimum loading and limited switching cycles.

Recording module 202 may be coupled to each energy resource in the micro-grid network 100 to receive and record at least one operational constraint corresponding to each energy resource. The operational constraints may be received and recorded dynamically. Alternatively, recording module 202 may have a pre-stored database of one or more operational constraints of the various energy resources such that the recording module 202 may not be coupled to the energy resources in the power network.

Receiving module 204 may obtain an environmental condition prediction. In some cases, the receiving module 204 is coupled to an external prediction module. The external prediction module may be a database containing a record of environmental conditions for certain locations over a length of time, such as over a few years. The records may be available for various periods of time, such as hourly, daily, weekly, monthly or annually etc. The external prediction module may also be an external source, such as a meteorological station, that carries out its own prediction of environmental conditions.

The receiving module 204 may alternatively, or in addition, be coupled to an internal prediction module. An internal prediction module may be equipped with sensors or other arrangements to predict the environmental conditions.

In some cases, in order to obtain an environmental condition prediction, the receiving module 204 may be configured to receive one or more environmental condition variables and generate the environmental condition prediction based on the one or more environmental condition variables. Examples of environmental condition variables predicted to estimate an environmental condition prediction may include a storm warning, wind speed, air density, irradiance, humidity, atmospheric turbulence, rain conditions, snow conditions, air temperature etc.

Receiving module 204 may also be configured to receive network disturbance signals as described herein. Network disturbance signals may include information on network disturbances such as sudden wind gust, wind power loss, loss of a dispatchable resource or system faults etc.

The processing module 212 may generate steady state signals (component control signals) and dynamic control signals for at least some of the energy resources. The processing module 212 may generate the component control signals, based on the environmental condition prediction and the operational constraints corresponding to the energy resources. The processing module 212 may generate dynamic control signals based on disturbances within the micro-grid network, environment condition prediction and/or operational constraints. In some cases, the environmental condition prediction relates to a first period of time but the component control signals and the dynamic control signals may be generated for another period of time.

The component control signals may be generated for any duration of time, such as 10 min., 15 min., or 30 min. etc., after which the component control signals are updated. In some cases, the component control signal may range over a few cycles, defined as a percentage of a duty cycle of the energy resources.

The dynamic control signals may be generated for duration of time shorter than the steady state component control signals. For example, the dynamic control signals may be generated for a time duration equal to or under one second etc.

In various cases, the processing module 212 may generate one or more of a power switching signal, a power level control signal and a charge/discharge signal. A power switching signal is a control signal in response to which an energy resource starts or stops supplying power to the network 100. A power level control signal is a control signal configuring an energy resource to supply power to the network 100 in a quantity corresponding to the power level control signal. A charge/discharge signal is a control signal configuring the energy storage elements in the network 100 to charge or discharge in response to the charge/discharge signal.

Processing module 212 may also be configured to receive acknowledgement signals from the various energy resources confirming the receipt of the component control signals.

Predicted demand module 206 may predict a load demand for the power network to provide a total predicted load demand. In various cases, the load demand is predicted in part based on at least one environmental condition variable or environmental condition prediction, as discussed herein.

The data storage module 208 may be the same as the storage module 185 or may be separate from the storage module 185. The data storage module 208 may be any data storage device known in the art, such as a hard disk drive, blue ray drive, tape drive, solid state drive, or DVD drive.

Data storage module 208 may store the operational constraints corresponding to each power source, the environmental condition prediction, the component control signals and the dynamic control signals generated for at least some of the energy resources.

Predicted supply module 214 may predict a power generation level of intermittent energy resources in the micro-grid network based on the environmental condition prediction. The predictions of the power generation level of intermittent energy resources in the network 100 may be used to provide a total predicted supply indicating a total supply from the intermittent energy resources at some future time. This information may be compared against the total predicted load demand for the same future time and the various energy resources of the power network may be controlled, i.e. turned on or off, configured to increase or decrease supply, or charge or discharge, accordingly and the extent of utilization of the dispatchable energy resources in the power network may be determined. For example, if the total predicted load demand exceeds the total predicted intermittent power generation system, the component control signal generated by the processing module may include a power level control signal to the dispatchable energy resources to gradually increase their production. A power level control signal may also be generated for an energy storage element to supply power to the load in the power network till the power supply levels of the dispatchable energy resources and the intermittent energy resources are sufficient to meet the total predicted load demand.

In various cases, the predicted supply module 214 may incorporate various data regarding the intermittent energy resources to determine a power generation level for intermittent energy resources. For example, wear and tear over time, know operational variations and other factors may affect the power output of an intermittent power source in response to a particular environmental condition. In some cases, the predicted supply module 214 may record the actual performance and power output of some or all of the intermittent energy resources in response to particular environmental conditions and subsequently use the recorded data to modify and improve the predicted power generation level.

Figure 2B:
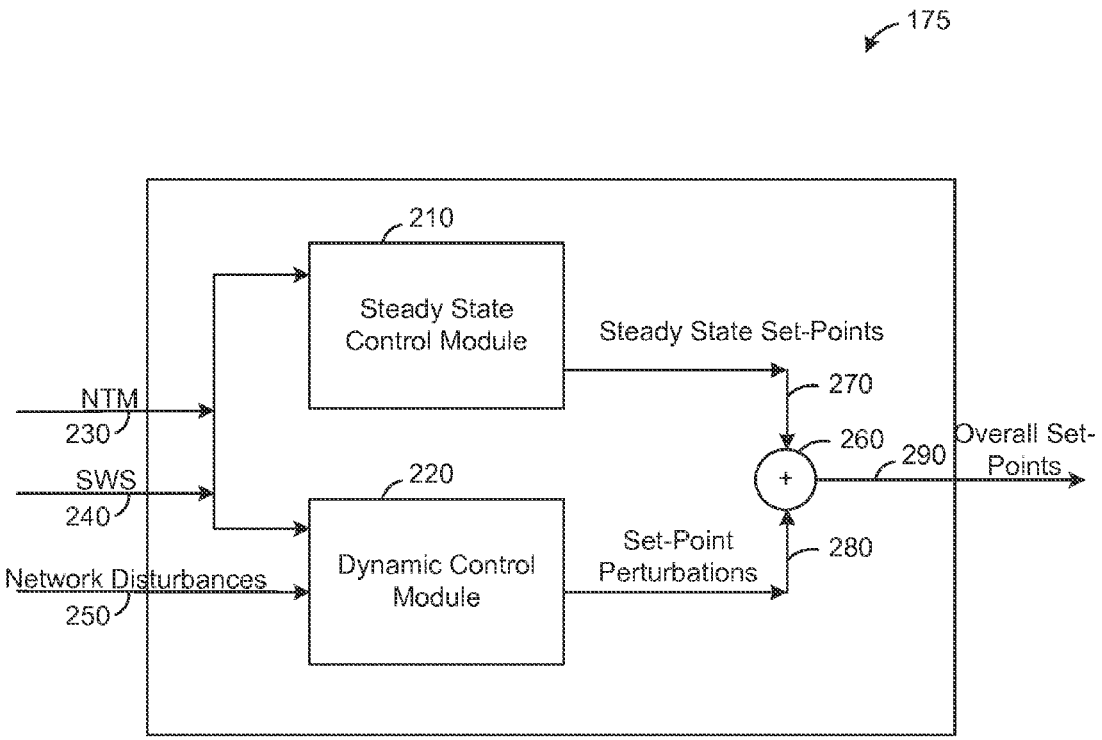
FIG. 2B is a block diagram of a controller in accordance with another example embodiment.

Reference is next made to FIG. 2B, illustrating a schematic block diagram of a system controller 175 in accordance with another example embodiment. System controller 175 comprises a steady state control module 210 and a dynamic control module 220.

Steady state control module 210 may increase intermittent energy resource penetration and minimize dispatchable resource consumption by optimizing the dispatch of various DERs. The optimization of dispatch schedule may be facilitated by forecasting load demand and supply. Steady state control module 210 may generate an optimal solution and provide steady state set-points for the various DERs. The optimal solution may be updated every 10 to 30 minutes and sent to the respective controllable resources of the micro-grid. In some other cases, network optimization solution may be updated less or more frequently than 10-30 minutes.

As illustrated, steady state control module 210 may receive network topology signals (NTM) 230 as inputs.

NTM 230 indicates status of various switching devices, such as the breakers, fuses, disconnects etc. in the micro-grid network 100.

Steady state module 210 may also receive system wide signal (SWS) 240 as input. SWS 240 may include micro-grid network 100 states and conditions. For example, SWS 240 contains data regarding network bus voltage magnitudes and angles, forecasted load values, state of charge of energy storage elements, forecasted environmental conditions or variables, forecasted supply values etc.

SWS 240 may also include various constraints within the network 100, such as constraints associated with DERs, network bus, real and reactive powers etc. For example, SWS 240 contains constrains such as line flow limits, bus voltage limits, real and reactive power limits of dispatchable energy resources and intermittent energy resources, modulation index limits, current limits of voltage-sourced converters, rate of change of state of charge of energy storage elements etc.

Steady state control module 210 may receive the NTM 230 and SWS 240 to optimize the network. Steady state control module 210 may provide the optimized solution to the DERs as optimal steady state set-points 270, such as, for example, real power set-point and reactive power set-point. Steady state set-points may include set-points for both dispatchable DERs and electronically-coupled DERs. Dispatchable DER set-points may include dispatch commands for the dispatchable energy resources, such as diesel generators. Electronically-coupled DER set-points may include dispatch commands for the electronically-coupled DERs, including intermittent energy resources and energy storage elements.

Dynamic control module 220 may be configured to control and maintain dynamic stability of micro-grids, such as micro-grid 100. Dynamic control module 220 may include a high resolution controller operable to generate set-point perturbations in response to system disturbances, such as, for example, addition of a new load, addition of a new supply source, removal or dropping of a load, removal or dropping of a supply source, sudden change in environmental conditions, such as, sudden wind gust, wind power loss etc. or other system faults.

For a disturbance occurring within a network, dynamic control module 220 stabilizes the network by maintaining the voltage and frequency of the network within pre-defined bounds. Dynamic control module 220 may dynamically generate component control signal for at least some of the distributed energy resources to maintain the system active and reactive powers. The dynamic generation of component control signals may be based on factors such as operational constraints of various DERs, total predicted load demand of the micro-grid network, network topology status etc.

Dynamic control module 220 dynamically uses energy storage elements 130 to maintain a short term balance between total source real power (p) and reactive power (q) and total load real power and reactive power. For example, an instantaneous wind gust may typically result in an increase in power output from a wind power source. If load demand remains the same as before the wind gust, this increase in power to the micro-grid may result in an undesirable increase in grid frequency. System controller 175 may compensate for such changes in power input to the electric grid by changing real and reactive set-points for the various dispatchable energy resources, intermittent power resources and/or the storage elements.

However, the dynamic control module 220 may also consider the operational constraints of the various DERs to determine which resources to engage in response to dynamic system disturbances. In the example of a sudden wind gust leading to an increase in wind power input to the electric grid, manipulating the operation of the dispatchable resource, such as a diesel generator, to turn it on or off abruptly, or ramp up or down the generation abruptly may result in generator failure and/or reduced efficiency of the generator as well as the overall micro-grid network.

Accordingly, in some cases, the dynamic control module 220 may configure a storage element to absorb the excess energy, thereby retaining the frequency and voltage of the electric grid within an acceptable range. Similarly, dynamic control module 220 may cause power to be extracted from a storage element to compensate for a decline in power in the micro-grid network.

The system controller 175 controls the various energy resources and storage elements by generating and transmitting component control signals containing control variables, data and instructions for the respective devices.

As illustrated, dynamic control module 220 receives NTM 230, SWS 240 and network disturbance signal 250 and generates set-point perturbations 280 corresponding to the various energy resources to control any abrupt changes in the network and maintain frequency and voltage of the system within pre-defined bounds.

Figure 3A:
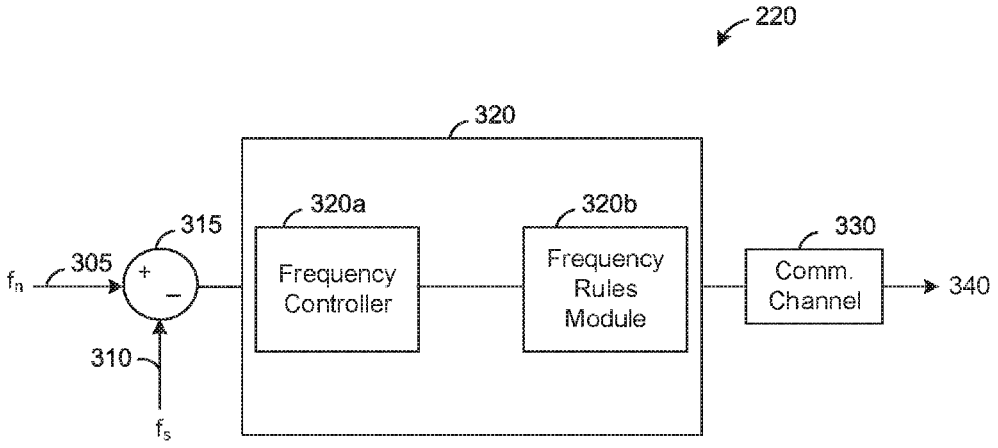
FIG. 3A is an example implementation of a frequency control system of a dynamic controller.

References is made to FIG. 3A illustrating a frequency control system of dynamic control module 220 in accordance with an example embodiment. Frequency of a network is governed by maintaining a balance between the generated and absorbed real power.

In the illustrated embodiment, frequency control system of FIG. 3A receives nominal frequency $f_n$ 305 and system frequency $f_s$ 310. Nominal frequency $f_n$ 305 may indicate the desired frequency or frequency range within which the micro-grid network should operate to maintain stability.

System frequency $f_s$ 310 may indicate generated or absorbed real power in the network. System frequency 310 may be measured or received at the point where the micro-grid is connectable to the utility grid.

Adder 315 may determine the change required in the generated or absorbed real power in the network to maintain the network frequency at a nominal value.

Frequency control module 320 may determine how the change in the frequency is shared between the various distributed energy resources subject to DER constraints. Frequency control module 320 includes a frequency controller 320*a* and frequency rules module 320*b* for providing sharing rules for frequency control.

Rules module 320*b* may receive and/or store rules regarding how to engage DERs to maintain nominal frequency in the network. Frequency controller 320*a* may access the rules module 320*b* and generate real power change set-point. The real power change set-point may be communicated to appropriate DER resources 340 via communication channels 330.

In some cases, rules module 320*b* may provide rules that allow only energy storage elements to be used to control frequency. This may be because the constraints of energy storage elements allow quick increase or decrease in energy supply or absorption facilitating a restoration of network frequency to the nominal value within a short duration of time.

In some other cases, rules module 320*b* may provide rules allowing for control of intermittent energy resources in response to system disturbances. Rules module 320*b* may also allow for load shedding in some cases.

Figure 3B:
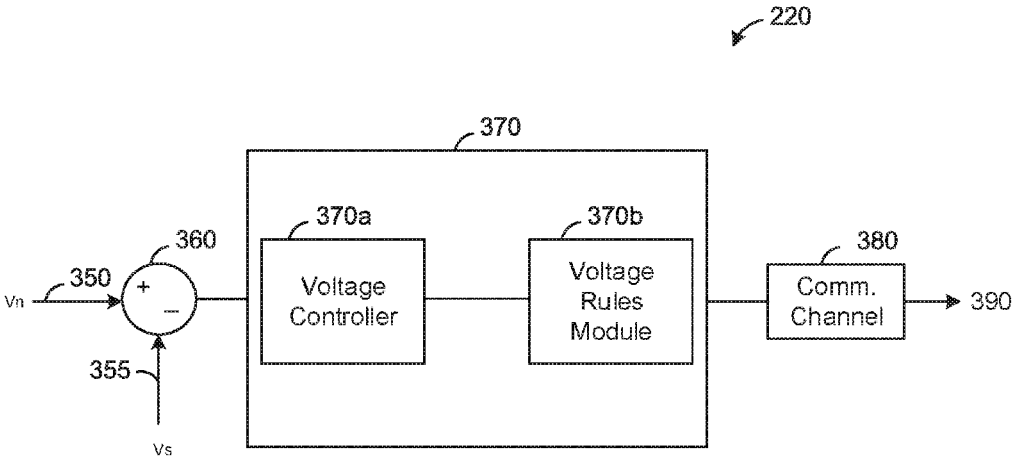
FIG. 3B is an example implementation of a voltage control system of a dynamic controller.

Reference is next made to FIG. 3B illustrating a voltage control system of dynamic control module 220 in accordance with an example embodiment. Voltage of a network may be controlled by injecting or absorbing reactive power.

In the illustrated embodiment, voltage control system of FIG. 3B receives nominal voltage $V_n$ 350 and system voltage $V_s$ 355. The system voltage $V_s$ 355 may be measured or received at the point where the micro-grid network is connectable to the utility grid.

Adder 360 may determine the change required in the reactive power in the network to maintain the network voltage at nominal value.

Voltage control module 370 may determine how the change in the voltage is shared between the various distributed energy resources subject to DER constraints. Voltage control module 370 includes a voltage controller 370*a* and a voltage rules engine 370*b*. Voltage rules engine 370*b* may be the same as rules engine 320*b*. Alternatively, separate rules engine 320*b* and 370*b* may be present for frequency control and voltage control respectively.

Voltage rules engine 370*b* may provide access to rules governing the control of various DERs to maintain a stable network voltage. Voltage controller 370*a* may access rules form the rules engine 370*b* and generate reactive power change set-points. The reactive power change set-points may be communicated to various DERs 390 via communication channels 380.

Reference is again made to FIG. 2B illustrating set-point perturbations 280. Set-point perturbations 280 may comprise real power change set-points and reactive power change set-points of FIGS. 3A and 3B.

Adder 260 may combine the real power change set-points of dynamic control module 220 to real set-points of steady state control module 210, and reactive power change set-points of dynamic control module 220 to reactive set-points of steady state control module 210 in situations of system disturbances. Signal 290 illustrates the overall set-points for the various DERs. Overall set-points 290 may be in the form of dispatch commands to the DERs. In various cases, DERs may have local controllers that control the charging, discharging, switching on and off, and generation level of the DERs. The local controllers may issue suitable dispatch instructions or signals to the respective DER based on the set-points received.

Figure 4:
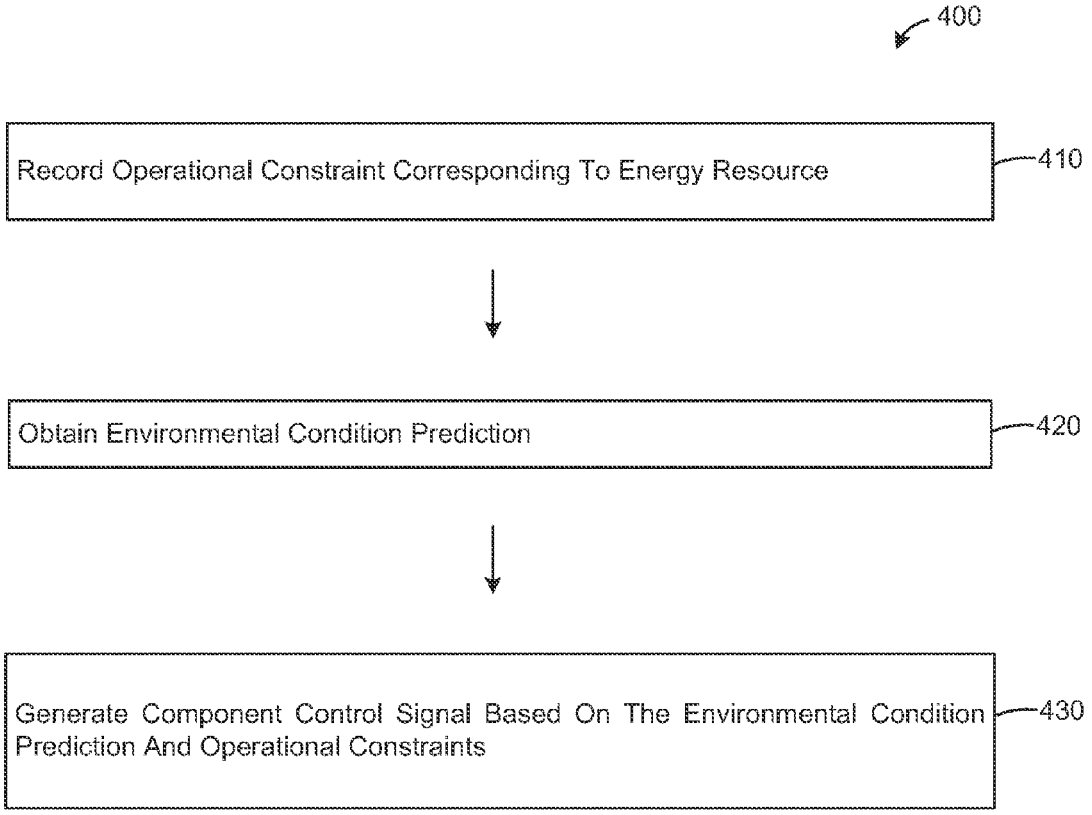
FIGS. 4-6 illustrate example process flows that may be followed by the system controller of micro-grid network of FIG. 1.

Reference is next made to FIG. 4 illustrating an example process flow 400 that may be followed by a system controller of a micro-grid network. Process flow 400 is configured for use in implementing micro-grid network 100 and system controller 175, as described above with reference to the examples shown in FIGS. 1, 2 and 3.

In the example shown, process flow 400 includes recording 410 at least one operational constraint corresponding to each energy resource. In some cases, recording at least one operational constraint may include identifying one or more operational constraints for one or more energy resources in the micro-grid network. In some other cases, recording at least one operational constraint may include receiving operational constraints associated with one or more energy resources in the network from external sources, such as, for example, the corresponding energy resources themselves or an external database etc. Recording at least one operational constraint may further include storing the received operational constraint corresponding to each energy resource.

Operational constraints may be defined as any limitations that prevent a system from realizing more of its goals. For example, for a dispatchable energy resource, such as, for example, a diesel generation resource, one of the operational constraints may be a minimum loading constraint imposing a minimum load requirement on the diesel generation resource.

Another example of an operational constraint for a diesel generation resource may include a maximum power constraint which imposes a limit on the maximum real and reactive power supplied by the diesel generation resource and is defined based on the instantaneous power of the diesel generation resource.

Operational constraint for a diesel generation resource may also include a minimum operating time which refers to a minimum on-time requirement for the diesel generation resource after each start-up to avoid short period of switch on/off and minimize cycling.

For an intermittent energy resource, such as, for example, a wind generation resource, operational constraints may include curtailment of wind power as wind penetration level rises. For instance, at low load levels and at times of high wind production, it may be necessary for security reasons of the power network to curtail the amount of wind generations. Other operational constraints for an intermittent energy resource may include a voltage variation limitation which imposes a condition that the voltage variation should not exceed a certain percentage of the nominal value, and a frequency variation limitation which imposes a condition that the maximum permanent system frequency variation should be maintain within a certain range of frequency levels. The operational constraints listed herein are by way of an example only and should not be construed as limiting the scope of the various examples enclosed herein.

In the example shown, flow 400 includes obtaining 420 an environmental condition prediction. In various cases, obtaining an environmental condition prediction may include obtaining an environmental condition prediction from an external source, such as, for example, a meteorological station. In some other cases, an environmental condition prediction may also be estimated from historical databases recording information such as environmental conditions in a certain location over a number of years. The information may be broken down in monthly or daily data and may be used to estimate a trend or a pattern of environmental conditions for that location.

The environmental condition prediction may be used to predict a power generation level of intermittent energy resources in the power network.

In some other cases, obtaining the environmental condition prediction may include receiving one or more environmental condition variables and generating the environmental condition prediction based on the one or more environmental condition variables.

In the example shown, process flow 400 includes generating 430 a component control signal for at least some of the energy resources, including the energy storage element, based on the environmental condition prediction and the operational constraints corresponding to the energy resource.

The component control signal corresponding to one or more of the energy resources may include a power switching signal for operating one or more energy resources to start or stop supplying power to the power network. The component control signal corresponding to one or more of the energy resources may also include a power level control signal for operating one or more energy resources to supply power to the micro-grid network in a quantity corresponding to the power level control signal.

In some further cases, the component control signal corresponding to one or more of the energy resources may include a source charge/discharge signal for operating one or more energy resources, specifically, one or more energy storage elements in the power network, to charge or discharge in response to charge/discharge signal.

Figure 5:
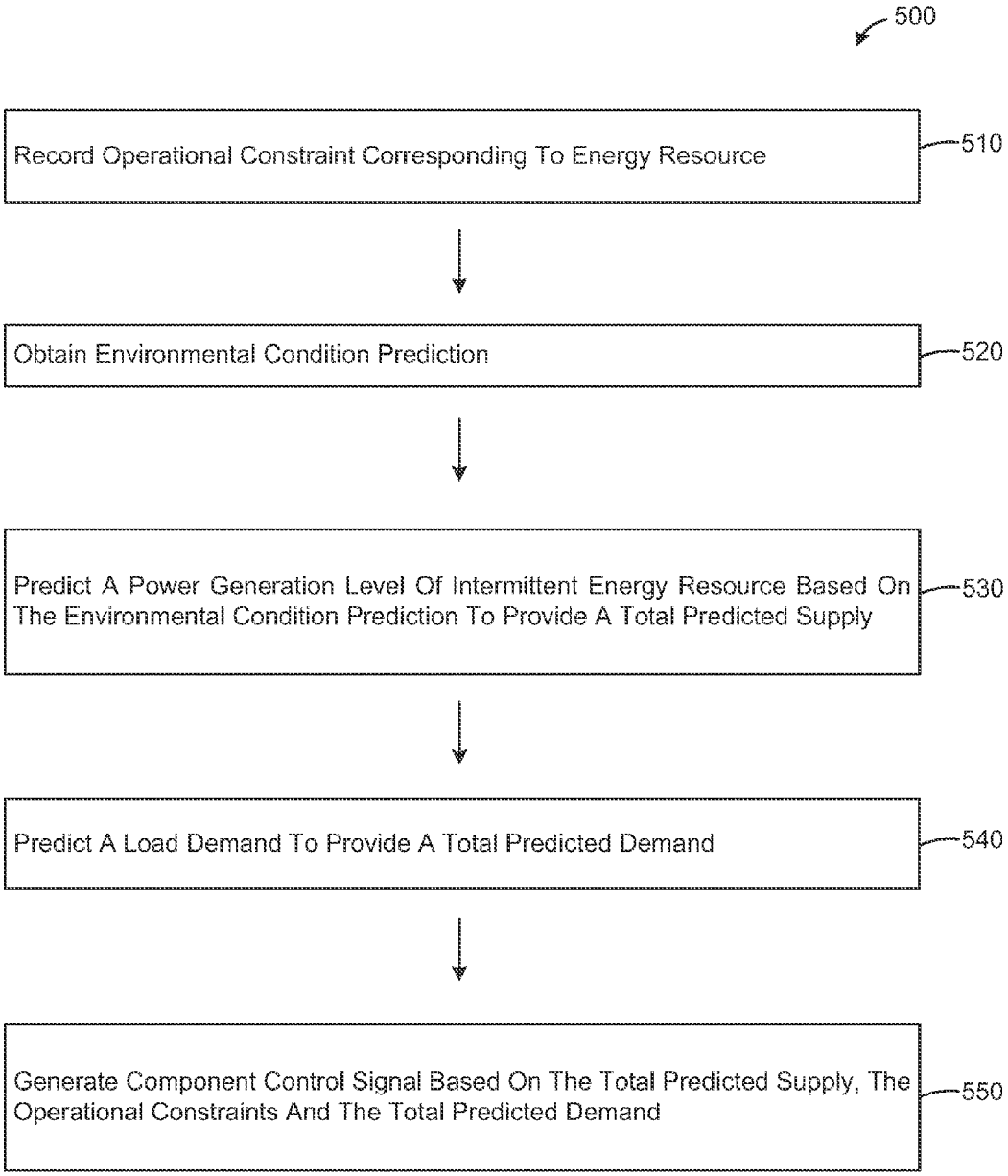

Reference is next made to FIG. 5, illustrating another example process flow 500 that may be followed by a system controller of a micro-grid network. In particular, the flow 500 is presented for use in conjunction with one or more functions and features described in FIGS. 1-4.

In the example shown, process flow 500 includes recording 510 at least one operational constraint corresponding to each energy resource and obtaining 520 an environmental condition prediction, such as, for example, from environmental condition prediction module 190 FIG. 1.

The process flow 500 further includes predicting 530 a power generation level of intermittent energy resources in the network based on the environmental condition prediction to provide a total predicted supply. Since at least one or more intermittent energy resources in the power network are responsive to environmental conditions to generate power, a power generation level of such intermittent energy resources may be predicted based on the environmental condition prediction.

For example, predictions regarding wind speeds and wind direction, or in other words, wind velocity, may be used to estimate a power generation level from a wind power generation system. The estimate may be based on different values of yaw angle or pitch angle of the wind turbine in the wind power generation system. Another example may include utilization of irradiance methods to predict solar energy production by a solar power generation system.

Prediction of power generation level from an intermittent energy resource responsive to environmental conditions to generate power may include using an energy forecasting simulation program that may include a model of the intermittent power source and may be able to simulate and predict a power generation level based on the environmental condition prediction.

The process flow further includes predicting 540 a load demand for the network to provide a total predicted load demand. In some cases, the load demand is predicted based on one or more environmental condition variables, such as wind speed, air density, irradiance, humidity, atmospheric turbulence, rain conditions, snow conditions, air temperature etc. For example, if environmental condition prediction indicates heavy snow conditions, an increase in the load demand is predicted based on increasing reliance and use of boilers, furnace, heat pumps, and heaters etc. for heating of air. As an another example, if environmental condition prediction indicates very high temperatures, an increase in the load demand is predicted based on increasing reliance and use of air conditioning, fans etc. to cool the air.

In some other cases, the load demand is predicted based on external databases which may include trends or patterns, or information from which trends or patterns may be deduced, of load demands in a certain location. External databases may be useful to provide trends or patterns over a few hours to days to months etc.

In some further cases, the load demand may be predicted based on energy demand forecasting simulation programs. For example, energy demand forecasting simulation programs, such as CEDMS (Commercial Energy Demand Model System) or REDMS (Residential Energy Demand Model System) may be used to predict load demand for a location that includes a solar generation power system.

The process flow further includes generating 550 the component control signal for at least some of the energy resources based on the total predicted load demand for the power network in addition to the environmental condition prediction and operational constraints corresponding to the energy resources.

Figure 6:
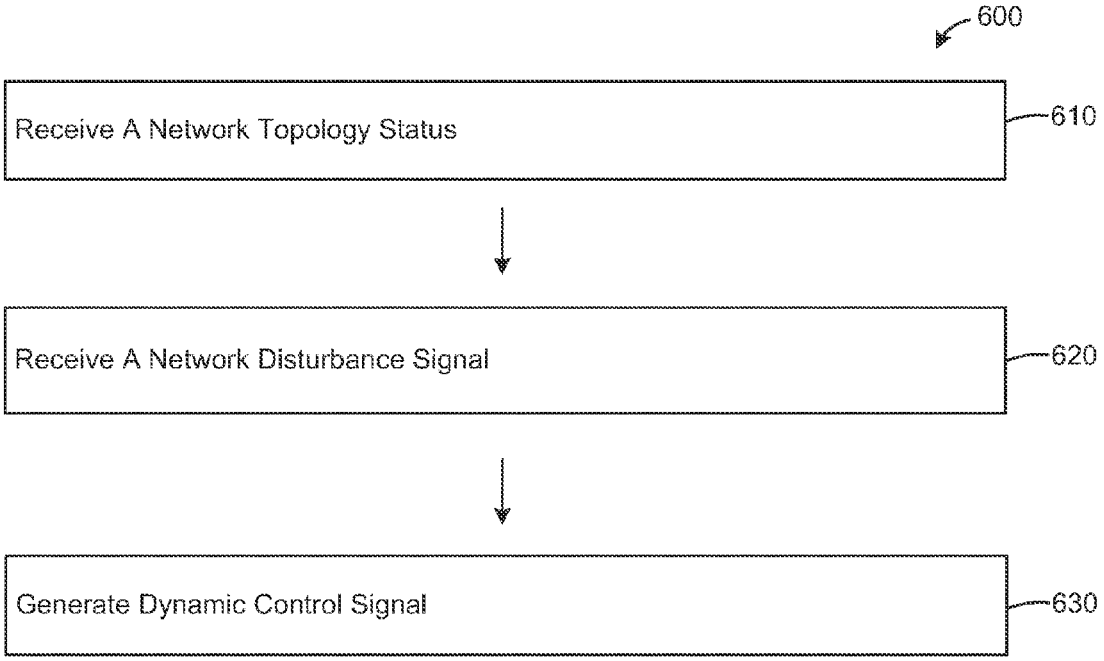

Reference is next made to FIG. 6, illustrating another example process flow 600 that may be followed by a system controller of a micro-grid network. In particular, flow 600 is presented for use in conjunction with one or more functions and features described in conjunction with FIGS. 1-5.

In the example shown, the process flow 600 includes receiving 610 a network topology status. Network topology status may include status of breakers, disconnects, fuses and other switching elements within the network.

At 620, system controller may receive network disturbance signals, as described herein. At 630, system controller may generate dynamic control signals to restore network stability based on the network topology status and network disturbance signals, as described herein. Dynamic control signals may include change set-points for real and reactive power to control and frequency and voltage of the micro-grid network.

In other embodiments, process flow 600 may also receive some or all of the operational constraints of energy resources, operational constraints of the network, predicted environmental conditions and load and supply predictions to generate the dynamic control signals.

Figure 7:
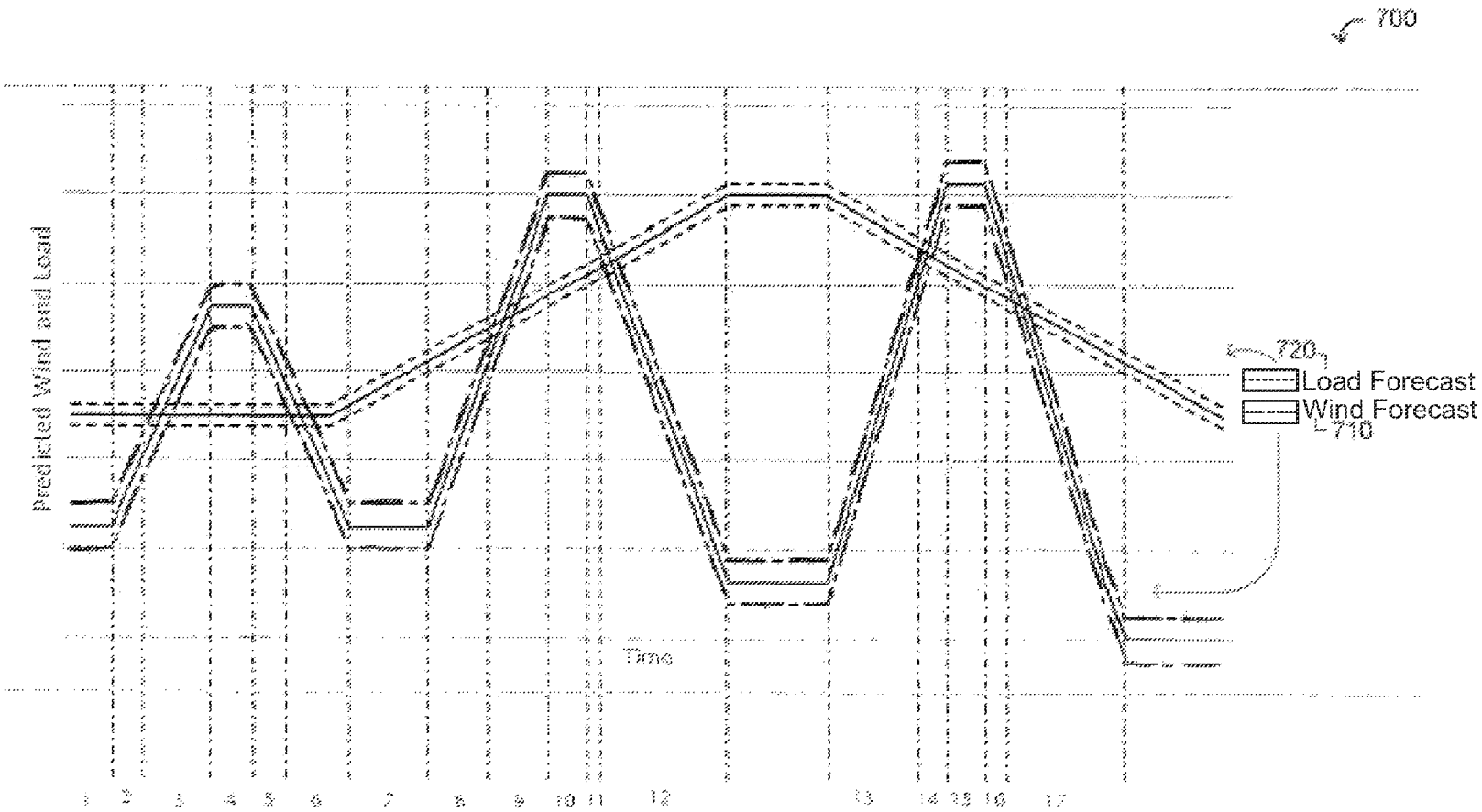
FIG. 7 is a steady state control response of the micro-grid system of FIG. 1 in accordance with an example embodiment.

Reference is now made to FIG. 7, which illustrates a predicted intermittent supply 710 from a wind based power generation resource and a predicted load demand 720 on an isolated power grid for a micro-grid network. Various scenarios of predicted intermittent supply 710 based on the environmental condition prediction and total predicted load demand 720 is illustrated. Various prediction uncertainties and safety factors are lumped together and illustrated by a dotted band surrounding the predicted intermittent supply 710 and total predicted load demand 720. Seventeen example scenarios are illustrated in the figure and discussed below. The various scenarios discussed herein are by way of example only and should not be construed as limiting the scope of the various cases enclosed herein. Various component control signals are dynamically generated for one or more of dispatchable energy resources, intermittent energy resources and energy storage elements depending on the various scenarios.

In various cases, a power network may include a plurality of dispatchable diesel energy resources, a plurality of intermittent wind based energy resources and one or more batteries based energy storage elements, which provide energy storage and may be referred to as batteries. This may be referred to as a wind-diesel-battery (WDB) configuration. A battery based energy storage device will typically have a device controller that controls the storage and release of energy to and from the battery. The device controller receives component control signals from a system controller 175 and operates the battery in response to the component control signals.

In other cases, the power network may include a plurality of dispatchable diesel energy resources, a plurality of intermittent wind based energy resources and one or more flywheel based energy storage devices, which provide energy storage and may be referred to as flywheels. This may be referred to as a wind-diesel-flywheel (WDF) configuration. A flywheel based energy storage device will also typically include a device controller that controls the storage and release of energy to and from the flywheel. In some cases, the device controller may be configured to receive component control signals from a system controller 175 and to control the storage or release of energy to and from in response to the component control signals. In other cases, the flywheel device controller may be configured to control the operation of the flywheel energy storage device according to a various processes directly.

The scenarios of FIG. 7 are discussed below in the context of a WDB configuration that is controlled by a power generation controller and a system controller similar to the power generation controller 170 and the system controller 175 in FIGS. 1-6. In some scenarios a WDF configuration is also discussed.

Scenario 1 illustrates a situation where the total predicted wind power supply and total predicted load demand are stable (i.e. are predicted to be unchanging) and the total predicted load demand exceeds total predicted wind supply. In this scenario, since the total predicted load demand exceeds total predicted wind supply, the component control signal to the wind power generation system may be a power level control signal configuring the wind power generation system to operate at its maximum capacity. The component control signal to the diesel power generation system may also be a power level control signal configuring the diesel power generation system to generate sufficient power to meet the total predicted load demand. No energy storage element is engaged in this scenario.

Scenario 2 illustrates a situation where the total predicted wind supply is increasing and total predicted load demand is stable. The total predicted load demand exceeds total predicted wind supply. In this scenario, the component control signals to the wind power generation system and the diesel power generation system may be similar to scenario 1, i.e. the component control signal to the wind power generation system may be a power level control signal configuring the wind power generation system to operate at its maximum capacity, in accordance with the operational constraints of the various energy resources. The component control signal to the diesel power generation system may also be a power level control signal configuring the diesel power generation system to dispatch required diesel to generate power to meet the total predicted load demand. The diesel energy resources in the system may have operational constraints that limit the rate at which the power output from them can be reduced. As power output from the wind energy resources or generation systems increases, the power output from the diesel energy resources will be reduced in compliance with these operational constraints. Depending on the rate at which the power output from the wind energy resources increases and the rate at which power output from the diesel power generators or generation systems can be decreased, it is possible that the total power output may exceed load demand.

In a WDB configuration, to comply with the operational constraints while preventing any imbalance in the power network, the controller may generate a component control signal for some or all of the battery storage elements to store any excess power generated by the combined wind and diesel energy resources. If all of the battery storage elements in the system have reached their maximum storage capacity, the controller may generate a component control signal to the wind power generation system to curtail extra power production.

Scenario 3 illustrates a situation where the total predicted wind supply is increasing and total predicted load demand is stable, while the total predicted wind supply exceeds total predicted load demand. When the total predicted wind supply exceeds the total predicted load demand, the total predicted wind supply is sufficient to meet the total predicted load demand and therefore diesel power generation systems in the power network are not needed to generate any power. However, in accordance with the operational constraints of some or all of the diesel power generators, the component control signals to the diesel power generation system may be a power level control signal configuring the diesel power generation system to ramp-down and turn-off gradually.

In a WDB configuration, a component control signal to the energy storage device may be a charge/discharge signal configuring the energy storage element to store or release energy with the uncertainty band. The energy storage element smooths variations in the actual power generation from the wind power generation system and the actual load demand, allowing the system to operate without use of the diesel power generation system. Similarly, in a WDF configuration, a component control signal may be a store/release signal that configures the flywheel energy storage element to store or release power.

In some cases, it may be desired or required in accordance with the operational constraints of the system or one or more of the diesel power generators to maintain one or more diesel generators in operation in this scenario, and perhaps at all times, in order to compensate for any unexpected decline in wind power generation. In such cases, the system controller may produce a component control signal to the diesel power generation system may be a power level control signal configuring the active diesel power generation systems in the power network to ramp-down and turn-off gradually with the exception of one diesel power generation system, which may be the unit with the lowest power production level or the highest cost efficiency at a low power output. In such cases, the component control signal to wind power generation system may be unchanged from before, i.e. the wind power generation system may still be configured to operate at a maximum or high capacity. In some cases, the component control signal to the wind power generation system may be a power level control signal configuring the wind power generation system to curtail extra production to prevent the operational constraint of the diesel power generation system with the lower power production level from being violated.

Scenario 4 illustrates a situation the total predicted wind supply and total predicted load demand are stable, while the total predicted wind supply exceeds total predicted load demand. In a WDB configuration, the component control signal to the diesel power generation systems in the power network is a power switching signal configuring all the active diesel power generation systems to turn off. The component control signal to the battery may be a charge/discharge signal configuring the battery to charge. If the total predicted wind supply still exceeds the total predicted load demand after all batteries (and any other energy storage elements), the component control signal to the wind power generation systems in the power network may be a power level control signal configuring the wind power generation system to curtail extra production.

In a WDF embodiment, the component control signal to the diesel power generation systems in the power network is a power switching signal configuring all the active diesel power generation systems to turn off, with the exception of the diesel power generation system with the lower power production level which is still maintained at the lowest load. In some cases, a diesel power generator that has the highest cost efficiency may be operated at the lowest load. The component control signal to the wind power generation systems in the power network is a power level control signal configuring the wind power generation system to curtail extra production.

Scenario 5 illustrates a situation where the total predicted wind supply is decreasing and total predicted load demand is stable. The total wind supply exceeds total predicted load demand. Since the total predicted wind supply is predicted to decrease. The system controller may determine that the diesel power generation systems may be required to supplement the wind power generation systems in the power network to meet the total predicted load demand in an upcoming time period or scenario. In this scenario, therefore, the component control signal to the diesel power generation system is a power level control signal configuring the diesel power generation systems in the power network to ramp-up and turn-on the diesel power generation systems gradually.

In a WDB configuration, the component control signal to wind power generation systems in the power network may be a power level control signal configuring the wind power generation system to maximize production. The component control signal to the battery may be a charge/discharge signal configuring the battery to charge or discharge in an uncertainty band to avoid the diesel power generation system from being turned on or off frequently, as required by an operational constraint of the diesel power generation system.

In a WDF configuration, the component control signal to wind power generation systems in the power network may be a power level control signal configuring the wind power generation system to maximize production, and to curtail any extra power production by the wind power generation systems in the power network.

Scenario 6 illustrates a situation where the total predicted wind supply is decreasing and total predicted load demand is stable, while the total predicted load demand exceeds total predicted wind supply. Since the total predicted wind supply is lower than the total predicted load demand, the component control signal to the wind power generation system may be a power level control signal configuring the wind power generation system to operate at its maximum capacity. The component control signal to the diesel power generation system is a power level control signal configuring the diesel power generation systems in the power network to ramp-up the diesel power generation systems gradually.

In a WDB configuration, the component control signal to the battery may be a charge/discharge signal configuring the battery to charge or discharge in an uncertainty band to avoid the diesel power generation system from being turned on or off frequently.

Scenario 7 illustrates a situation where the total predicted wind supply is stable and total predicted load demand is increasing, while the total predicted load demand exceeds total predicted wind supply. In this scenario, since the total predicted load demand exceeds total predicted wind supply, the component control signal to the wind power generation system may be a power level control signal configuring the wind power generation system to operate at its maximum capacity. The component control signal to the diesel power generation system is a power level control signal configuring the diesel power generation system to dispatch required diesel power generation to generate power to meet the total predicted load demand.

Scenario 8 illustrates a situation where the total predicted wind supply and the total predicted load demand are increasing, while the total predicted load demand exceeds total predicted wind supply. In this scenario, the component control signal to the wind power generation system may be a power level control signal configuring the wind power generation system to operate at its maximum capacity and the component control signal to the diesel power generation system may be a power level control signal configuring the diesel power generation system to dispatch required diesel to generate power to meet the total predicted load demand. In some cases, where the rate of increase of the total predicted wind supply is predicted to be greater than the rate of the increase of the total predicted load demand, the component control signal to the diesel power generation systems is a power level control signal configuring the diesel power generation system to ramp-down gradually, in accordance with their respective operational constraints.

Scenario 9 illustrates a situation where the total predicted wind supply and the total predicted load demand are increasing, while the total predicted wind supply exceeds total predicted load demand. As previously mentioned in relation to scenario 3, since the total predicted wind supply exceeds the total prediction load demand, the total predicted wind supply is sufficient to meet the total predicted load demand and therefore various diesel power generation systems in the power network are not needed to generate any power. However, to prevent the operational constraints of the diesel power generation system from being violated, the component control signal to the diesel power generation system is a power level control signal configuring the diesel power generation system to ramp-down and turn-off gradually. The component control signal to the wind power generation system may be a power level control signal configuring the wind power generation system to operate at its maximum capacity.

In a WDB configuration, the component control signal to the battery may be a charge/discharge signal configuring the battery to charge or discharge in an uncertainty band to avoid the diesel power generation system from being turned on or off frequently, as required by another operational constraint of the diesel power generation system. In such cases, when the storage elements in the power network are predicted to have reached their maximum capacity, the component control signal to the wind power generation system may be a power level control signal configuring the wind power generation system to curtail supply to the power network.

In a WDF configuration, the component control signal to the diesel power generation system may be a power level control signal configuring the active diesel power generation systems in the power network to ramp-down and turn-off gradually with the exception of the diesel power generation system with the lower power production level. In such cases, the component control signal to the wind power generation system may be a power level control signal configuring the wind power generation system to curtail extra production to prevent the operational constraint of the diesel power generation system with the lower power production level from being violated.

Scenario 10 illustrates a situation where the total predicted wind supply is stable and total predicted load demand is increasing, while the total predicted wind supply exceeds total predicted load demand.

In a WDB configuration, the component control signal to the diesel power generation system is a power level control signal configuring the diesel power generation system to turn-off gradually. The component control signal to the wind power generation system may be a power level control signal configuring the wind power generation system to operate at its maximum capacity. The component control signal the battery, may be a charge/discharge signal configuring the battery to charge or discharge in an uncertainty band to avoid the diesel power generation system from being turned on or off frequently. In such cases, when the storage elements in the power network are predicted to have reached their maximum capacity, the component control signal to the wind power generation system may be a power level control signal configuring the wind power generation system to curtail supply to the power network.

In a WDF configuration, the component control signal to the diesel power generation systems in the power network is a power switching signal configuring all the active diesel power generation systems to turn off, with the exception of the diesel power generation system with the lowest power production level or highest cost efficiency which is still maintained at the lowest load. The component control signal to the wind power generation systems in the power network is a power level control signal configuring the wind power generation system to operate at its maximum capacity; however, if the total supply exceeds the total predicted load demand, the component control signal to the wind power generation system may be a power level control signal configuring the wind power generation system to curtail extra production to prevent the operational constraint of the diesel power generation system with the lower power production level from being violated.

Scenario 11 illustrates a situation where the total predicted wind supply is decreasing and total predicted load demand is increasing, while the total predicted wind supply exceeds total predicted load demand. In this scenario, the component control signal to the wind power generation system is a power level control signal configuring the wind power generation system to operate at its maximum capacity.

In a WDB configuration, the component control signal to the diesel power generation system is a power level control signal configuring the diesel power generation system to dispatch required diesel to generate power to meet the total predicted load demand. The component control signal to the battery may be a charge/discharge signal configuring the battery to charge to avoid the diesel power generation system operational constraints from being violated. However, if the various active energy storage elements in the power network are already charged to their maximum capacity, the component control signal to the wind power generation system is a power level control signal configuring the wind power generation system to curtail extra production.

In a WDF configuration, the component control signal to the diesel power generation system is a power level control signal configuring the component control signal to the diesel power generation system is a power switching signal configuring the diesel power generation systems in the power network to turn-on gradually.

Scenario 12 illustrates a situation where the total predicted wind supply is decreasing and total predicted load demand is increasing. The total predicted load demand exceeds total predicted wind supply. The component control signal to the wind power generation system may be a power level control signal configuring the wind power generation system to operate at its maximum capacity. The component control signal to the diesel power generation system may also be a power level control signal configuring the diesel power generation system to dispatch required diesel to generate power to meet the total predicted load demand.

Scenario 13 illustrates a situation where the total predicted wind supply is increasing and total predicted load demand is decreasing, while the total predicted load demand exceeds total predicted wind supply.

In a WDB configuration, the component control signal to the diesel power generation system is a power level control signal configured to turn-off gradually. The component control signal to the battery energy storage element may be a power switching signal configuring the energy storage element to supply power to the power network.

In a WDF configuration, the component control signal to the diesel power generation system may be a power level control signal configuring the active diesel power generation systems in the power network to turn-off gradually with the exception of the diesel power generation system with the lower power production level or the highest cost efficiency.

Scenario 14 illustrates a situation where the total predicted wind supply is increasing and total predicted load demand is decreasing, while the total predicted wind supply exceeds total predicted load demand.

In a WDB configuration, the component control signal to the diesel power generation system is a power level control signal configuring the diesel power generation system to turn-off gradually. The component control signal to the wind power generation system may be a power level control signal configuring the wind power generation system to operate at its maximum capacity. The component control signal to the battery may be a charge/discharge signal configuring the battery to charge or discharge in an uncertainty band to avoid the diesel power generation system from being turned on or off frequently. In such cases, when the energy storage elements in the power network are predicted to have reached their maximum capacity, the component control signal to the wind power generation system may be a power level control signal configuring the wind power generation system to curtail supply to the power network.

In a WDF configuration, the component control signal to the diesel power generation system may be a power level control signal configuring the active diesel power generation systems in the power network to ramp-down and turn-off gradually with the exception of the diesel power generation system with the lowest power production level or the highest cost efficiency. In such cases, the component control signal to wind power generation system is a power level control signal configuring the diesel power generation to operate at maximum capacity. However, the component control signal to the wind power generation system may be a power level control signal configuring the wind power generation system to curtail extra production to prevent the operational constraint of the diesel power generation system with the lower power production level from being violated.

Scenario 15 illustrates a situation where the total predicted wind supply is stable and total predicted load demand is decreasing, while the total predicted wind supply exceeds total predicted load demand.

In a WDB configuration, the component control signal to the diesel power generation system is a power level control signal configuring the diesel power generation system to turn-off gradually. The component control signal to the wind power generation system may be a power level control signal configuring the wind power generation system to operate at its maximum capacity. The component control signal to the battery may be a charge/discharge signal configuring the battery to charge or discharge in an uncertainty band to avoid the diesel power generation system from being turned on or off frequently. In such cases, when the energy storage elements in the power network are predicted to have reached their maximum capacity, the component control signal to the wind power generation system may be a power level control signal configuring the wind power generation system to curtail supply to the power network.

In a WDF configuration, the component control signal to the diesel power generation systems in the power network is a power switching signal configuring all the active diesel power generation systems to turn off, with the exception of the diesel power generation system with the lower power production level which is still maintained at the lowest load. The component control signal to the wind power generation systems in the power network is a power level control signal configuring the wind power generation system to operate at its maximum capacity; however, if the total supply exceeds the total predicted load demand, the component control signal to the wind power generation system may be a power level control signal configuring the wind power generation system to curtail extra production to prevent the operational constraint of the diesel power generation system with the lower power production level from being violated.

Scenario 16 illustrates a situation where the total predicted wind supply and the total predicted load demand are decreasing, while the total predicted wind supply exceeds total predicted load demand. In such situation, the component control signal to the wind power generation system is a power level control signal configuring the wind power generation system to operate at its maximum capacity.

In WDB configuration, the component control signal to the diesel power generation system is a power level control signal configuring the diesel power generation system to dispatch required diesel to generate power to meet the total predicted load demand. The component control signal to the battery may be a charge/discharge signal configuring the battery to charge or discharge in an uncertainty band to avoid the diesel power generation system from being turned on or off frequently. In such cases, when the energy storage elements in the power network are predicted to have reached their maximum capacity, the component control signal to the wind power generation system may be a power level control signal configuring the wind power generation system to curtail supply to the power network.

In a WDF configuration, the component control signal to the diesel power generation systems in the power network is a power switching signal configuring all the active diesel power generation systems to turn off gradually. In such cases, when the energy storage elements in the power network are predicted to have reached their maximum capacity, the component control signal to the wind power generation system may be a power level control signal configuring the wind power generation system to curtail supply to the power network.

Scenario 17 illustrates a situation where the total predicted wind supply and the total predicted load demand are decreasing, while the total predicted load demand exceeds total predicted wind supply. The component control signal to the wind power generation system may be a power level control signal configuring the wind power generation system to operate at its maximum capacity. The component control signal to the diesel power generation system may also be a power level control signal configuring the diesel power generation system to dispatch required diesel to generate power to meet the total predicted load demand.

The scenarios of FIG. 7 and the corresponding operation of systems in a WDB or WDF configuration have been described here only be way of example. The specific selection of loading of different dispatchable energy resources, intermittent energy resources and the specific usage of energy storage elements may vary depending on the operational goals of the system operator. For example, a system operator may wish to maximize the use of wind, solar or other energy resources that are powered by free or low cost energy sources. In such cases, the system operator will maximize the use of these intermittent energy resources, as described above in relation to FIG. 6, in accordance with operational constraints of the system and its components. In other cases, the system operator's goals may vary and the system controller will be configured in accordance with those goals.

The present invention has been described here by way of example only. Various modification and variations may be made to these exemplary embodiments without departing from the spirit and scope of the invention, which is limited only by the appended claims.

We claim:

1. A method of controlling a micro-grid network, wherein the network includes a plurality of distributed energy resources including at least one dispatchable energy resource and at least one intermittent energy resource, wherein at least one distributed energy resource is an energy storage element and at least one of the intermittent energy resources is responsive to environmental conditions to generate power, the method comprising:

providing a controller comprising a processor, a memory coupled to the processor and an adder, the memory having installed thereon a computer-executable code defining a steady state control module and a dynamic control module;

recording, in the memory, at least one operational constraint corresponding to each distributed energy resource;

receiving, by the processor, one or more system wide signals representative of a predicted change to the network, wherein the predicted change comprises an environmental condition prediction;

periodically generating, in a predetermined frequency, by the steady state control module, a component control signal for each distributed energy resource in a first set of distributed energy resources, including the energy storage element, based on the environmental condition prediction and the at least one operational constraint corresponding to the respective distributed energy resource, wherein the component control signal defines a steady state set-point for each distributed energy resource of the first set of the distributed energy resources;

receiving, by the processor, one or more network disturbance signals representative of a sudden change within the network;

selecting, by the dynamic control module, from the plurality of distributed energy resources, a second set of distributed energy resources having respective at least one operational constraints suitable to be engaged to address the sudden change within the network, the second set of distributed energy resources having at least the energy storage element and at least one other type of distributed energy resource in common with the first set of distributed energy resources;

dynamically generating, by the dynamic control module, a dynamic control signal for each distributed energy resource in the second set of distributed energy resources, based on the one or more network disturbance signals and the at least one operational constraint corresponding to the respective distributed energy resource to address the sudden change within the network, the dynamic control signal defining a set-point perturbation to the respective steady state set-points of each distributed energy resources in the second set of distributed energy resources;

combining, using the adder, the steady state set-point of each distributed energy resources in the second set of distributed energy resources generated by the steady state control module with the respective set-point perturbation of each distributed energy resources in the second set of distributed energy resources generated by the dynamic control module to generate an overall control signal; and maintaining a voltage and a frequency of the network within a predetermined range with the overall control signal.

2. The method of claim 1, wherein the environmental condition prediction relates to a time period and the component control signals are generated for the time period.

3. The method of claim 2, further comprising:

predicting a load demand for the micro-grid network to provide a total predicted load demand; and wherein generating the component control signal for each of the first set of distributed energy resources comprises generating the component control signal based on the total predicted load demand for the micro-grid network.

4. The method of claim 3, wherein the load demand is predicted in part based on the at least one environmental condition variable.

5. The method of claim 2, wherein the time period is selected from the group consisting of:

a predetermined number of seconds; and a percentage of a duty cycle of the energy resources.

6. The method of claim 1, wherein obtaining the environmental condition prediction includes receiving at least one environmental condition variable and generating the environmental condition prediction based on the at least one environmental condition variable.

7. The method of claim 1, further comprising:

predicting a power generation level of intermittent energy resources in the micro-grid network based on the environmental condition prediction to provide a total predicted supply.

8. The method of claim 7, wherein the intermittent energy resource is a wind power generation system and the dispatchable energy resource is a diesel power generation system.

9. The method of claim 8, wherein the energy storage element is a battery.

10. The method of claim 9, wherein the component control signal generated for each of at least some of the distributed energy resource from the first set is selected from the group consisting of:

a power switching signal to turn off the dispatchable energy resources, a charge/discharge signal to at least one energy storage element to charge the at least one energy storage element and a power level control signal to the intermittent energy resources to curtail supply to the micro-grid network in excess of total predicted load demand and power stored by the at least one energy storage element in the power network when a total predicted wind power supply in the micro-grid network exceeds the total predicted load demand in the micro-grid network and the total predicted wind power supply and the total predicted load demand in the micro-grid network are stable;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply in the micro-grid network is stable and the total predicted load demand in the micro-grid network is increasing;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply in the micro-grid network is stable and the total predicted load demand in the micro-grid network is decreasing;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply in the micro-grid network is increasing and the total predicted load demand in the micro-grid network is stable a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply in the micro-grid network is increasing and the total predicted load demand in the micro-grid network is increasing;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply is increasing and the total predicted load demand in the micro-grid network is decreasing;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production when a total predicted wind power supply in the micro-grid network exceeds the total predicted load demand in the micro-grid network, the total predicted wind power supply in the micro-grid network is decreasing and the total predicted load demand in the micro-grid network is stable;

a power level control signal to the dispatchable energy resources to dispatch required diesel, a charge/discharge signal to at least one energy storage element to charge the at least one energy storage element and a power level control signal to the intermittent energy resources to maximize production but to curtail supply to the micro-grid network based on the operational constraints of the dispatchable energy resources when a total predicted wind power supply in the micro-grid network exceeds the total predicted load demand in the micro-grid network, the total predicted wind power supply in the micro-grid network is decreasing and the total predicted load demand in the micro-grid network is increasing;

a power level control signal to the dispatchable energy resources to gradually decrease supply, a charge/discharge signal to at least one energy storage element to charge or discharge the at least one energy storage element based on the operational constraints of the dispatchable energy resources and a power level control signal to the intermittent energy resources to maximize production but curtail supply to the micro-grid network in excess of the total predicted load demand and power stored by the at least one energy storage element in the micro-grid network when a total predicted wind power supply in the micro-grid network exceeds the total predicted load demand in the micro-grid network, the total predicted wind power supply in the micro-grid network is decreasing and the total predicted load demand in the micro-grid network is decreasing;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, and the total predicted wind power supply and the total predicted load demand in the micro-grid network are stable;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is increasing and the total predicted load demand in the micro-grid network is stable;

a power level control signal to the dispatchable energy resources to gradually increase supply, a charge/discharge signal to at least one energy storage element to charge or discharge the at least one energy storage element based on the operational constraints of the dispatchable energy resources and a power level control signal to the intermittent energy resources to maximize production when a total predicted load demand in the micro-grid network exceeds the total predicted wind power supply in the micro-grid network, the total predicted wind power supply in the micro-grid network is decreasing and the total predicted load demand in the micro-grid network is stable;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is stable and the total predicted load demand in the micro-grid network is increasing;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is increasing and the total predicted load demand in the micro-grid network is increasing;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is decreasing and the total predicted load demand in the micro-grid network is increasing;

a power switching signal to the dispatchable energy resources to gradually stop supplying power and a power level control signal to at least one energy storage element to supply power to the micro-grid network when a total predicted load demand in the micro-grid network exceeds the total predicted wind power supply in the micro-grid network, the total predicted wind power supply in the micro-grid network is increasing and the total predicted load demand in the micro-grid network is decreasing; and a component control signal for at least some of the energy resources comprises generating a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is decreasing and the total predicted load demand in the micro-grid network is decreasing.

11. The method of claim 8, wherein the energy storage element is a flywheel.

12. The method of claim 11, wherein the component control signal generated for each of at least some of the distributed energy resources from the first set is selected from the group consisting of:

a power switching signal to turn off the dispatchable energy resources except the diesel power generation system with the lower power production and a power level control signal to the intermittent energy resources to curtail supply to the micro-grid network in excess of total predicted load demand when a total predicted wind power supply in the micro-grid network exceeds the total predicted load demand in the micro-grid network, and the total predicted wind power supply and the total predicted load demand in the micro-grid network are stable;

a power switching signal to turn off the dispatchable energy resources except the diesel power generation system with the lower power production and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is stable and the total predicted load demand in the micro-grid network is increasing;

a power switching signal to turn off the dispatchable energy resources except the diesel power generation system with the lower power production and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is stable and the total predicted load demand in the micro-grid network is decreasing;

a power level control signal to the dispatchable energy resources to gradually decrease supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is increasing and the total predicted load demand in the micro-grid network is stable;

a power level control signal to the dispatchable energy resources to gradually decrease supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is increasing and the total predicted load demand in the micro-grid network is increasing;

a power level control signal to the dispatchable energy resources to gradually decrease supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply is increasing and the total predicted load demand in the micro-grid network is decreasing;

a power level control signal to the dispatchable energy resources to gradually increase supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is decreasing and the total predicted load demand in the micro-grid network is stable;

a power level control signal to the dispatchable energy resources to gradually increase supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is decreasing and the total predicted load demand in the micro-grid network is increasing;

a power level control signal to the dispatchable energy resources to gradually increase supply and a power level control signal to the intermittent energy resources to maximize production but curtail supply to the micro-grid network in excess of total predicted load demand when a total predicted wind power supply in the micro-grid network exceeds the total predicted load demand in the micro-grid network, the total predicted wind power supply in the micro-grid network is decreasing and the total predicted load demand in the micro-grid network is decreasing;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, and the total predicted wind power supply and the total predicted load demand in the micro-grid network are stable;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is increasing and the total predicted load demand in the micro-grid network is stable;

a power level control signal to the dispatchable energy resources to gradually increase supply and a power level control signal to the intermittent energy resources to maximize production but curtail supply to the micro-grid network in excess of total predicted load demand when a total predicted load demand in the micro-grid network exceeds the total predicted wind power supply in the micro-grid network, the total predicted wind power supply in the micro-grid network is decreasing and the total predicted load demand in the micro-grid network is stable;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is stable and the total predicted load demand in the micro-grid network is increasing;

a power switching signal to turn off the dispatchable energy resources except the diesel power generation system with the lower power production and a power level control signal to the intermittent energy resources to maximize production but curtail supply to the micro-grid network in excess of total predicted load demand when a total predicted load demand in the micro-grid network exceeds the total predicted wind power supply in the micro-grid network, the total predicted wind power supply in the micro-grid network is increasing and the total predicted load demand in the micro-grid network is increasing;

a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is decreasing and the total predicted load demand in the micro-grid network is increasing;

a power switching signal to turn off the dispatchable energy resources when a total predicted load demand in the micro-grid network exceeds the total predicted wind power supply in the micro-grid network, the total predicted wind power supply in the micro-grid network is increasing and the total predicted load demand in the micro-grid network is decreasing; and a power level control signal to the dispatchable energy resources to dispatch required diesel and a power level control signal to the intermittent energy resources to maximize production when a total predicted load demand in the micro-grid network exceeds the total predicted wind power supply in the micro-grid network, the total predicted wind power supply in the micro-grid network is decreasing and the total predicted load demand in the micro-grid network is decreasing.

13. The method of claim 1, further comprising:

operating at least some of the distributed energy resources, including the energy storage element, in response to the component control signal.

14. The method of claim 1, wherein at least one operational constraint corresponding to each distributed energy resource includes at least one operational constraint selected from the group consisting of a switching cycle constraint and a minimum load constraint.

15. The method of claim 1, wherein the component control signal corresponding to at least one of the distributed energy resource from the first set is selected from the group consisting of:

a power switching signal, wherein the at least one distributed energy resource starts or stops supplying power to the micro-grid network in response to the power switching signal a power level control signal, wherein the at least one distributed energy resource supplies power to a hybrid power grid in a quantity corresponding to the power level control signal;

a source charge/discharge signal, wherein the energy storage element in the micro-grid network charges or discharges in response to the charge/discharge signal; and a source store/release signal, wherein the energy storage element in the micro-grid network stores or releases power in response to the store/release signal.

16. The method of claim 1, wherein recording the at least one operational constraint corresponding to each distributed energy resource includes receiving at least one operational constraint from each distributed energy resource and storing the at least one operational constraint corresponding to the distributed energy resource.

17. The method of claim 1, further comprising receiving micro-grid network topology status indicating status of switching elements in the micro-grid network, wherein generating the component control signal for each distributed energy resource of the first set comprises generating the component control signal based on the micro-grid network topology status.

18. The method of claim 1, wherein the dynamic control signal is generated for a time period shorter than a time period during which the component control signal is generated.

19. The method of claim 1, wherein at least one network disturbance signal is selected from the group consisting of:

a signal indicating a sudden change in load demand of the micro-grid network;

a signal indicating a sudden change in supply from at least one distributed energy resource of the micro-grid network; and a signal indicating a sudden change in environmental condition.

20. The method of claim 1, wherein generating the dynamic control signal comprises generating a signal selected from the group consisting of:

a real power change signal for maintaining the frequency of the micro-grid network at a nominal value; and a reactive power change signal for maintaining the voltage of the micro-grid network at a nominal value.

21. The method of claim 1, wherein selecting the second set of distributed energy resources comprising distributed energy resources having respective at least one operational constraint suitable to be engaged for addressing the sudden change within the network comprises:

identifying at least one distributed energy resources from the at least one dispatchable energy resources having a corresponding at least one operational constraints suitable to be engaged for addressing the predicted change; and selecting the at least one distributed energy resource in the second set.

22. A system of controlling a micro-grid network, the system comprising:

a plurality of distributed energy resources including at least one dispatchable energy resource and at least one intermittent energy resource, wherein at least one distributed energy resource is an energy storage element and at least one of the intermittent energy resources is responsive to environmental conditions to generate power;

a plurality of loads coupled to the plurality of distributed energy resources;

a controller coupled to the plurality of distributed energy resources and the plurality of loads, the controller comprising a processor and a memory coupled to the processor, the controller further comprising a steady state control module, a dynamic control module and an adder coupled to the steady state control module and the dynamic control module, wherein:

the controller is configured to receive at least one operational constraint corresponding to each distributed energy resource;

the memory is configured to record the at least one operational constraint corresponding to each distributed energy resource;

the processor is configured to receive one or more system wide signals representative of a predicted change to the network, wherein the predicted change comprises an environmental condition prediction;

the steady state control module is configured to periodically generate, in a predetermined frequency, a component control signal for each distributed energy resource in a first set of distributed energy resources, including the energy storage element, based on the environmental condition prediction and the at least one operational constraint corresponding to the respective distributed energy resource, wherein the component control signal defines a steady state set-point for each distributed energy resource of the first set of the distributed energy resources;

the processor is further configured to receive one or more network disturbance signals representative of a sudden change within the network;

the dynamic control module is configured to select from the plurality of distributed energy resources, a second set of distributed energy resources having respective at least one operational constraints suitable to be engaged to address the sudden change within the network, the second set of distributed energy resources having at least the energy storage element and at least one other type of distributed energy resource in common with the first set of distributed energy resources;

the dynamic control module being further configured to dynamically generate a dynamic control signal for each distributed energy resource in the second set of distributed energy resources, based on the one or more network disturbance signals and the at least one operational constraint corresponding to the respective distributed energy resource to address the sudden change within the network, the dynamic control signal defining a set-point perturbation to the respective steady state set-points of each distributed energy resources in the second set of distributed energy resources;

the adder being configured to combine the steady state set-point of each distributed energy resources in the second set of distributed energy resources generated by the steady state control module with the respective set-point perturbation of each distributed energy resources in the second set of distributed energy resources generated by the dynamic control module to generate an overall control signal; and the controller being further configured to maintain a voltage and a frequency of the network within a predetermined range with the overall control signal.

23. The system of claim 22, wherein the environmental condition prediction relates to a time period and the component control signals are generated for the time period.

24. The system of claim 23, wherein the time period is selected from the group consisting of:

a few seconds; and a percentage of a duty cycle of the energy resources.

25. The system of claim 22, wherein the controller is further configured to predict a load demand for the micro-grid network to provide a total predicted load demand; and wherein the steady state control module is configured to generate the component control signal for each of the first set of distributed energy resources based on the total predicted load demand for the micro-grid network.

26. The system of claim 25, wherein the load demand is predicted in part based on the at least one environmental condition variable.

27. The system of claim 22, wherein the processor is configured to receive at least one environmental condition variable and generate the environmental condition prediction based on the at least one environmental condition variable.

28. The system of claim 22, wherein the processor is further configured to predict a power generation level of intermittent energy resources in the micro-grid network based on the environmental condition prediction to provide a total predicted supply.

29. The system of claim 22, wherein the at least one network disturbance signal is selected from the group consisting of:

a signal indicating a sudden change in load demand of the micro-grid network;

a signal indicating a sudden change in supply from at least one distributed energy resource of the micro-grid network; and a signal indicating a sudden change in the environmental condition.

30. The system of claim 22, wherein the dynamic control module is configured to generate the dynamic control signal selected from the group consisting of:

a real power change signal for maintaining frequency of the micro-grid network at a nominal value; and a reactive power change signal for maintaining voltage of the micro-grid network at a nominal value.

* * * * *